United States Patent [19]

Parmley

[11] Patent Number: 4,992,669

[45] Date of Patent: Feb. 12, 1991

[54] MODULAR ENERGY SYSTEM

[76] Inventor: Daniel W. Parmley, 129 E. Citation La., Tempe, Ariz. 85284

[21] Appl. No.: 310,988

[22] Filed: Feb. 16, 1989

[51] Int. Cl.[5] ..... F02B 65/00

[52] U.S. Cl. ..... 290/1 R; 123/2

[58] Field of Search ..... 290/1 R, 1 A, 1 C; 123/2, 3, DIG. 6, DIG. 7

[56] References Cited

U.S. PATENT DOCUMENTS

| | | | |
|---|---|---|---|
| 1,380,123 | 5/1921 | Sullivan | 290/1 A |
| 2,251,722 | 8/1941 | Thomas | 64/13 |
| 2,961,549 | 11/1960 | Shipitalo | 290/1 |
| 3,418,485 | 12/1968 | Anderson et al. | 290/1 |
| 3,536,928 | 10/1970 | Jones, Jr. et al. | 290/1 |
| 3,602,730 | 8/1971 | Cushing | 307/150 |
| 3,805,082 | 4/1974 | Murray | 290/1 |
| 4,136,432 | 1/1979 | Melley, Jr. | 29/469 |
| 4,350,123 | 9/1982 | Kossek et al. | 123/2 |
| 4,539,483 | 9/1985 | Freeny, Jr. | 290/1 R |
| 4,757,786 | 7/1988 | Ellegard | 123/2 |

*Primary Examiner*—A. D. Pellinen
*Assistant Examiner*—W. E. Duncanson, Jr.
*Attorney, Agent, or Firm*—Banner, Birch, McKie and Beckett

[57] ABSTRACT

A modular energy system including separable driving and driven units and a transfer system for rapidly and easily replacing these units as needed. The driving unit includes a power plant and associated controls protectively housed in a sturdy module container. The driven unit includes shaft drivable equipment and associated controls protectively housed in another sturdy module container. A disconnectable drive shaft extendable between the containers drivingly connects the output of the power plant with the equipment. Swivelable wheel assemblies are easily positionable underneath the module containers so that they can be moved longitudinally and laterally by a winch of the transfer system on and between a flatbed truck and a nearby transfer dock.

20 Claims, 19 Drawing Sheets

MODULAR ENERGY SYSTEM

BACKGROUND OF THE INVENTION

In conventional, permanently installed power and mechanical equipment, such as computer and communication systems, located inside of buildings, a failure of either the driving or the driven load components results in the use of highly skilled workers and equipment to remove the defective electrical or mechanical components and replace them with new working components. Valuable time is lost and great expenses are thereby incurred.

Critical equipment located inside of ordinary buildings can be completely destroyed when a disaster occurs. Systems and equipment installed in permanent structures also do not lend themselves well to repairs and modification. Additionally, the labor, materials and equipment necessary to remove or to increase the size of the system are very expensive.

As an example, where computer and communication systems are mounted within a building structure and then they are destroyed, as by fire from an adjacent warehouse, great cost and problems are involved in relocating to a temporary off-site computer room until a new permanent structure can be built. The design of many large computer and communication systems is such that if a disaster were to strike, they would be completely or substantially destroyed.

Large sums of money are often spent building temporary sites after the disaster has already occurred. Rebuilding the damaged facility and replacing the equipment is also very expensive. Business can be thereby disrupted, customers lost and an irrevocable financial strain suffered. The major causes of destruction of facilities housing critical systems are fire, storms, floods, earthquakes and sabotage.

Fires which have destroyed computer rooms often do not start within the room themselves but rather travel to the room causing the roofs and walls of the room to collapse. Halon and sprinklers inside the computer room are of little value when the total building is engulfed in flames. In fact, in many cases more damage is done to the sensitive equipment by the water used to put the fire out than by the fire itself.

Storms and tornados carrying high winds and rain often do not directly reach the equipment itself but still destroy it by collapsing the surrounding walls and roof on it. The major cause of storm damage to equipment located inside multi-story and even single-story conventional buildings is the collapse of the housing structure onto the equipment. Something as simple as clogged roof drains have caused building roofs to cave in destroying the equipment in the buildings.

Many computer rooms and critical equipment are located in low areas, such as in basements and ground floors, which are susceptible to flood damage. Clogged sewers, overloaded storm drains and local down pours have also caused extensive damage to critical systems.

Earthquakes occur not only in high risk areas but also in areas normally considered to be safe or immune to earthquakes. The earthquakes collapse structures onto the equipment inside of them. In most of these structures, the only design consideration is to protect the system from the outside environment and not from the structure itself.

Utilities especially in hot climates charge more (often double) for electricity during the peak (air conditioning) utilization hours than off-peak hours, say 9:00 p.m. to 6:00 a.m. Thermal storage systems to take advantage of the cheaper off-peak electricity are now used. They typically entail digging an ice storage pit, insulating the pit and building an adjacent structure to house the ice making and other equipment. This is a time consuming and expensive construction. Warm water from an existing chilling system is then run (during peak hours) through the ice stored in the pit and the chilled water returns to the chilling system.

Correction facilities are rapidly overcrowding. Temporary facilities, such as mobile homes, have been brought in and used. They are easily and frequently torn up and damaged by the inmates. If there is any combustible material in them, the inmates often set them on fire.

SUMMARY OF THE INVENTION

Accordingly, a principal object of the present invention is to provide a design for better protecting critical systems, such as computer or communication systems, from physical damage.

Another object of the present invention is to provide improved modular system designs which do not require highly skilled workers and equipment to remove and replace their damaged driving and/or driven load components.

A further object of the present invention is to provide improved modular designs for large systems and equipment which allow the modules to be easily repaired, modified and/or replaced.

A still further object of the present invention is to provide a modular system having an improved swivable wheel assembly which can be easily installed to and beneath the modules by one semi-skilled worker without any special equipment thereby facilitating removal and installation of the modules.

Another object is to provide an improved transportable ice (builder) for building chilled water systems.

A further object is to provide an improved destruction resistant modular living unit as part of a military or corrections facility.

Directed to achieving these objects, a novel modular energy system is herein provided. The energy system includes a prime mover, such as an engine, motor or turbine, and a driven load, such as a generator, compressor or water pump. The energy system preferably includes two modules, one housing the prime mover and one housing the driven load. The modules are made from sturdy, internationally standardized, ocean cargo containers that are used to transport products by land or sea. These outdoor modules which utilize heavy gauge steel walls with fire resistant insulation substantially reduce the possibility that the equipment therein will be damaged in the event of a disaster.

The prime mover module contains an engine, an electric motor, a turbine or any other power source that supplies shaft driven power. The prime mover modules are self-contained and have their own cooling system. A pre-cooled heat exchanger can be installed in them for use when external cooling water, as from well pumps or cooling towers, is available. The prime mover can thereby be cooled without using a fan motor and energy thereby conserved. The driven unit contains a generator, a water pump, a compressor or any other piece of equipment that can be shaft driven. Many combinations of different modules can be connected together end-to-end by a commonly adaptable drive shaft. These modules are designed to contain complete self-supporting systems for electrical and mechanical equipment including computer and communication systems with power and air conditioning units installed within the same container.

A specially-designed rapid transfer system using a steel track enables the modules to be separately replaced without highly skilled personnel or conventional heavy equipment, such as forklifts or cranes. The transfer system includes easily installable, pivotable wheels for the modules, a transfer dock, and a flat bed semi-trailer with a winch for wheeling the modules on and between the flat bed trailer and the transfer dock. The modules can also be stacked on top of one another to thereby reduce the amount of ground (or floor) space needed.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
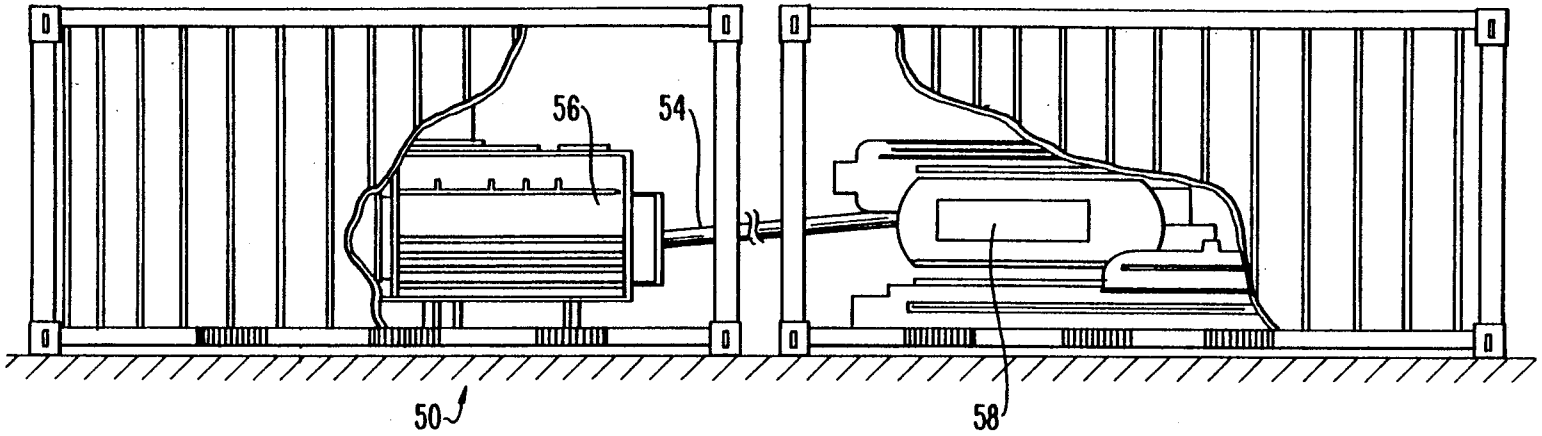
FIG. 1 is a sectional side elevational view of a first interconnected driving and driven module system of the present invention.

FIG. 1 shows a first embodiment of the present invention which comprises a prime mover module shown generally at 50 and a driven module shown generally at 52. A drive shaft 54 drivingly and operatively connects the motor 56 of the prime mover module 50 to the shaft driven compressor 58 of the driven module 52. The motor 56 can be a standard seven hundred horse power electric motor, and the compressor 58 can be a standard six hundred ton refrigeration compressor.

Figure 2:
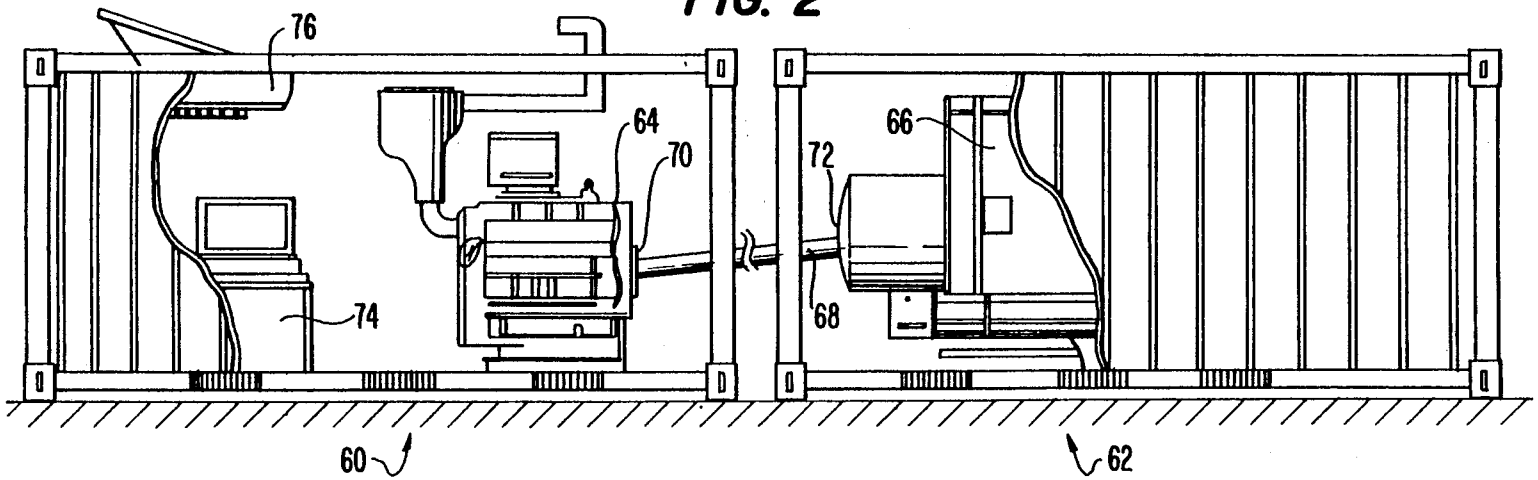
FIG. 2 is a sectional side elevational view of a second interconnected module system of the present invention.

FIG. 2 shows a second embodiment of the present invention which comprises a prime mover module 60 and a driven module 62. The prime mover module 60 encloses a standard seven hundred horse power piston engine 64, and the driven module 62 contains a standard five hundred kilowatt electric generator 66. The engine 64 transmits mechanical energy through a universally-adaptable drive shaft 68 to the generator 64. The drive shaft 68 is designed to fit all other driven units of the same general horse power range. The engine drive shaft flange 70 corresponds to the generator flange 72. Computer and computer controls 74 and optional equipment security and safety systems are also housed in the prime mover module 60. A fan coil 76 cools the water system of the engine 64 and draws fresh air across the engine.

Figure 3:
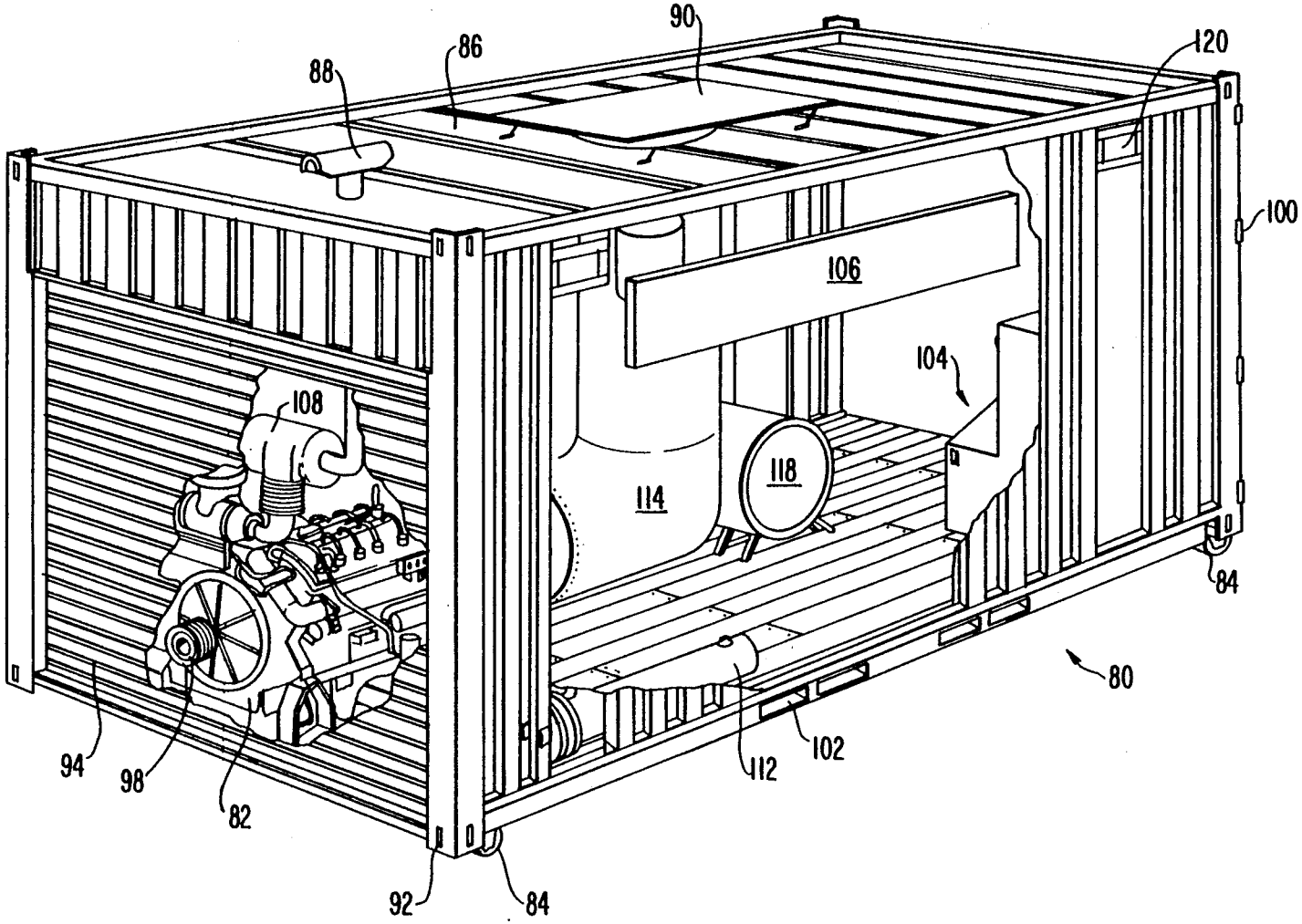
FIG. 3 is a sectional perspective view of a prime mover module of the present invention, such as might be used in the system of FIG. 2.

FIG. 3 shows a prime mover module 80 of the present invention designed to generate mechanical shaft power from a natural gas fuel engine 82. The engine 82 of this prime mover module 80 supplies shaft-driven mechanical power to any suitable load. Removable rotating wheel assemblies 84, as will be described in detail later in connection with FIGS. 11–27, can be installed when the system is to be portable without the use of cranes or forklifts. As will be apparent these wheel assemblies 84 advantageously fit entirely underneath (within the perimeter of) the module. This is an improvement over known systems such as the wheel units of the TREWHELLA T24 and T36 Container Transport Units, which project beyond or outside of the container perimeter. The roof 86 of the module 80 has an engine exhaust stack 88 and an air vent cover 90 which is spring-loaded to open when the system is operating.

This particular module 80 is an eight foot wide by eight-and-a-half foot high by twenty foot long converted ocean cargo container. These containers, which can be used for any of the embodiments described herein, are available from Sea Land and typically have sturdy sixteen to eighteen gauge steel walls. It is known to convert and use these containers for the storage of construction equipment and the like and also as heated and cooled office space by installing dry wall and the like and bathroom facilities in them. At the corners of the module 80 are the (internationally standardized) ISO connector openings 92 which are of international standard dimensions. A rollup door 94 at an end of the module 80 provides access to the engine 82, the drive shaft connections, and all other connections associated with electrical, fuel fluid exchange and communication. When the system is in normal operation, the rollup door 94 is raised above the drive shaft flange 98 (or 70) allowing access to the internal connections. Standard swing out doors 100 provide access on either end of the module 80. The module 80 can be picked up and moved by a forklift (not shown) by engaging through the lower forklift holes 102. The security and safety systems of this module 80 are controlled by the computer controller and monitor station shown generally at 104. A user or owner logo panel 106 can also be conveniently provided on a side of the module 80.

The engine 82, whose exhaust muffler is shown by reference numeral 108, can be fueled by many different types of fuels, such as diesel, gasoline, LPG and natural gas, depending upon the desired application. The drive shaft flange couplings 98 are similar on all output shafts in design, size, range and center dimensions. A heat exchanger 112 within the module 80 is used for cooling the engine 82 or a pre-heater for an external hot water system. Cooling air is drawn by the fan of the engine 82 over the engine, through the engine cooling air exhaust 114 and to the roof exhaust. Proper oil level is maintained in the engine 82 on a continuous running basis by the engine lube oil reservoir 118. When the module 80 is stored and all other vents are closed, the air breather vent 120 is used.

Figure 4:
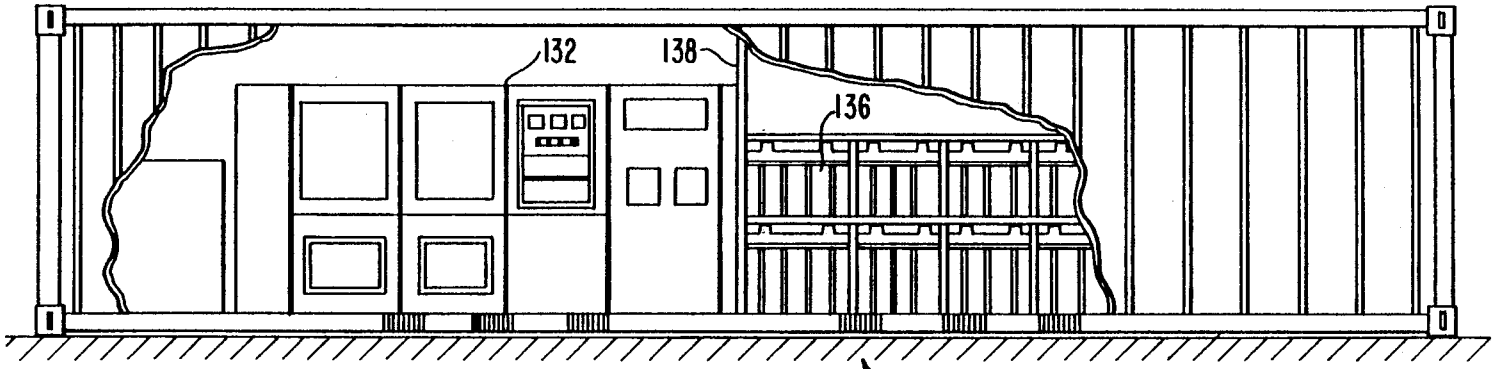
FIG. 4 is a sectional side elevational view of a module of the present invention containing a wall that separates the uninterruptible power supply and the power distribution unit thereof from the battery compartment.

FIG. 4 shows a modular energy system of the present invention contained in a forty foot long module 130. Contained within this module 130 are a two hundred KVA uninterruptable power supply (UPS) 132, a power distribution unit (PDU) 134 and a battery system 136. A wall 138 separates the UPS 132 and the battery system 136 to prevent any hazardous gases from the batteries from entering the electronics portion of the system.

Figure 5:
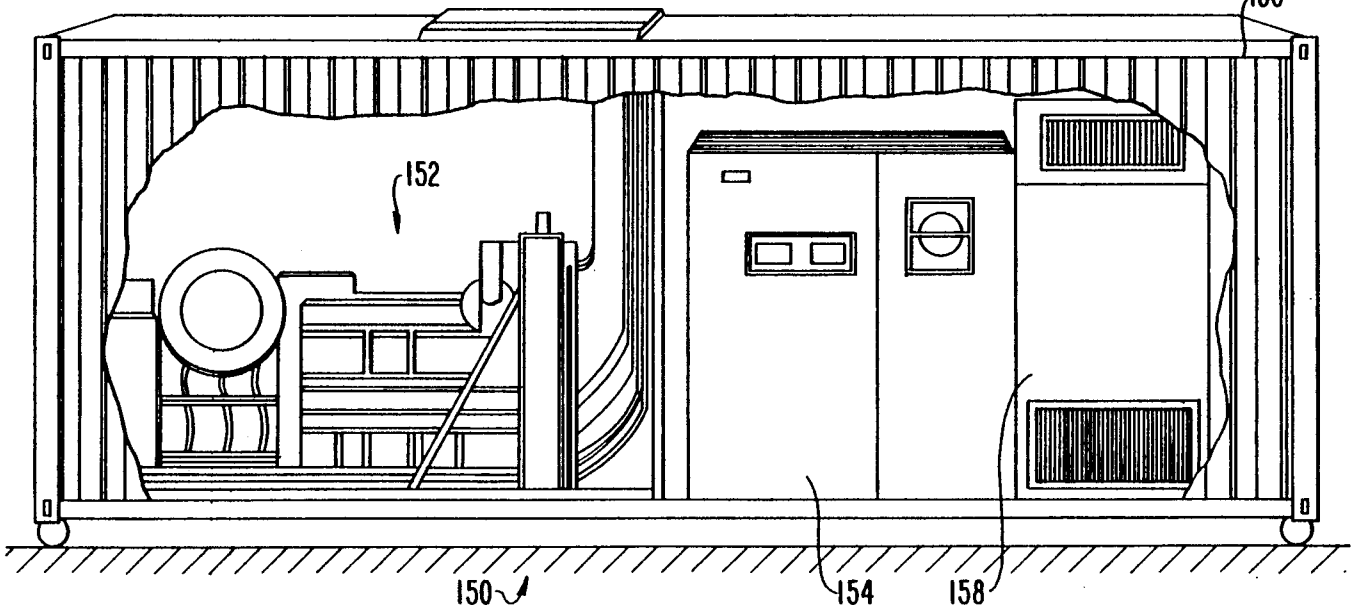
FIG. 5 is a sectional side view of a module of the present invention.

FIG. 5 shows a generator and UPS package modular system 150 of the present invention. This system 150 is used for critical electrical loads that cannot have any disruption in power between the time utility power drops off and the generator starts. A unique aspect of this invention is that all of the major components—the generator system shown generally at 152, the uninterruptable power system 154 and the air conditioner 155—and all associated wirings are contained in one insulated modular container 156. The generator system 152 includes an engine air filter **152*a*, an electric generator four hundred and eighty VAC output 152*b*, a one hundred and fifty kilowatt diesel generator set 152*c*, a radiator 152*d* and an air exhaust duct 152*e*. An air vent 152*f* automatically opening on air pressure is provided in the ceiling or roof 152*g*. An interior insulated wall 156*a* separates the generator system 152 and the uninterruptable power system 154. The UPS 154 includes a thirty KVA UPS unit, four hundred and eighty volt input, 120/208 V output with a UPS control panel 157. The air conditioner 155 is a five ton computer room grade air conditioning unit to cool the UPS unit and includes an air conditioning discharge grill 159 and a filtered return vent 160. This modular system 150** can be brought to the site and more quickly installed with the rapid transfer system of the present invention than can conventional systems.

Figure 6:
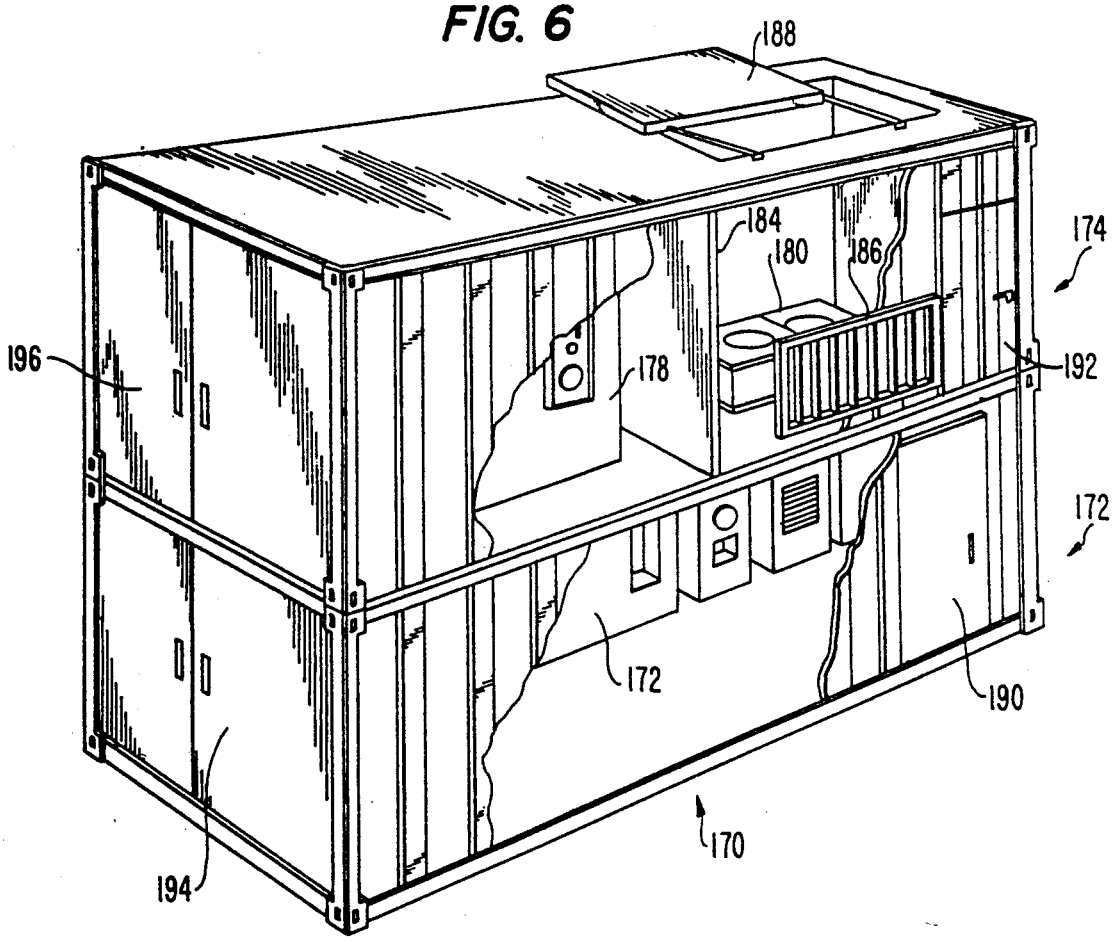
FIG. 6 is a sectional perspective view of modules of the present invention shown in a stacked arrangement.

FIG. 6 shows a self-contained computer system of the present invention generally at 170. This system 170 is shown with the two modules 172, 174 thereof stacked (as by a forklift or a crane) to conserve ground space. The bottom module 172 contains the computer and communications equipment 176, and the top module 174 contains the power and air conditioning 178. The air conditioning condenser 180 is separated from the indoor air handler by a wall 184. A fresh air grill 186 brings outside air into the module to pick up heat in the condenser 180, and then expel it through the roof vent 188. Small man doors 190, 192 in the modules 172, 174 are located at opposite ends of equipment doors 194, 196 to provide access to an adjacent building, if needed.

Figure 7:
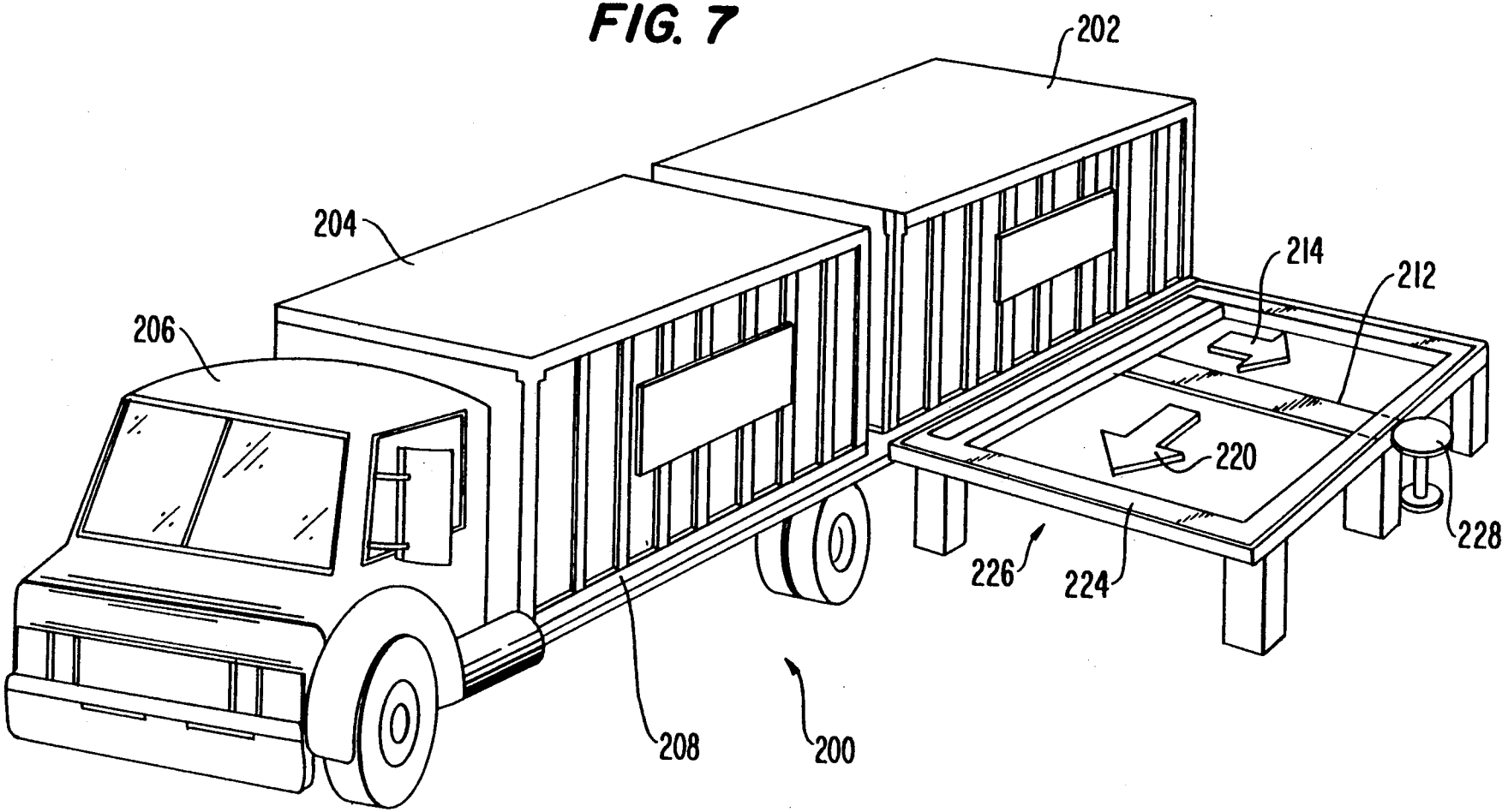
FIG. 7 is a perspective view of a module rapid transfer system of the present invention, such as might be used for the modules of FIGS. 1 and 2.
Figure 8:
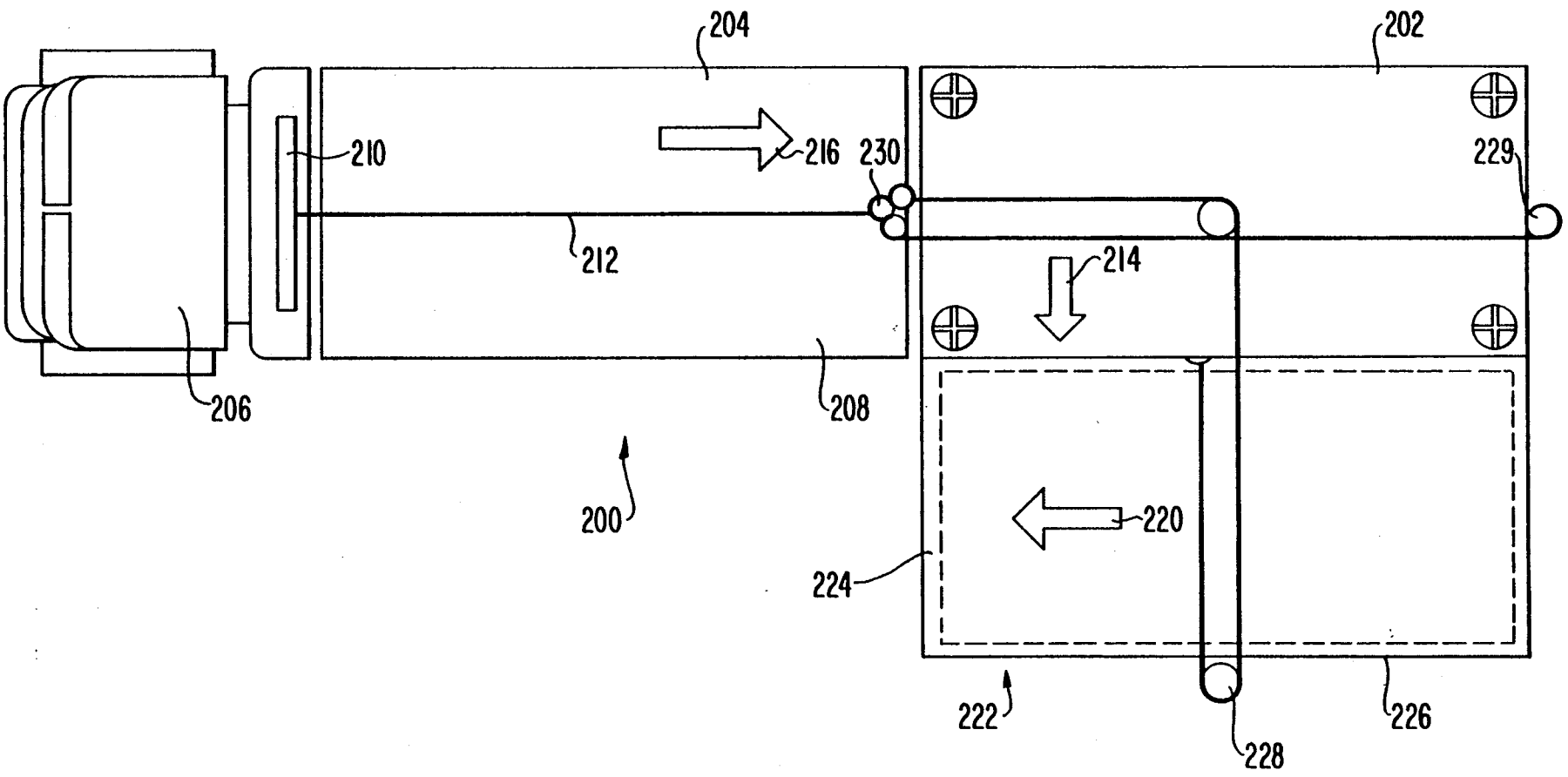
FIG. 8 is a top plan view of the rapid transfer system of FIG. 7.

FIGS. 7 and 8 show a rapid transfer system of the present invention generally at 200 used in conjunction with modular units 202, 204. These modular units 202, 204 can be any of the units for example as shown in FIGS. 1–6. They can be standard eight feet wide, eight and one-half feet high and twenty feet long modules with any suitable material or equipment, as previously described, enclosed within them. The truck or semi-trailer 206 has a trailer bed 208 which is at least twenty-two feet long where the modular units 202, 204 are twenty feet long. Modular units over twenty feet longer require semi-trailers of the proper longer length. An electric winch 210 is fitted to the truck 206 at the front of the bed 208, as shown schematically in FIG. 8. With the winch steel cables 212 properly arranged below the modular units 202, 204, the winch 210 is operated to move the existing modular unit 202 out of the way to the right as indicated by arrow 214. The cable 212, which is a one-half inch extra-flex wire rope, is then reconnected to the other modular unit 204 located on the vehicle bed 208 and winched into the spot left by the modular unit 202; this movement is shown by arrow 216 in FIG. 8. The modular unit 202, which has been moved out of the way to the right, is now ready to be loaded onto the repositioned empty truck bed 208; this loading movement is shown by arrow 220.

The track system 222 of the transfer system 200 includes eight inch channel irons 224 on which the modular units ride to the proper location relative to the transfer dock 226. The lateral sheave 228 is used to pull the modular unit 202 to the right, as shown by the arrow 214, to make room for the new modular unit 204 located on the truck bed 208. The steel cable 212 is connected to the vehicle winch 210 through the sheave system and to the modular unit. The normally empty track 224 is used for transferring the modular unit 202 to the transfer location on the transfer dock 226. The steel cable 212 of the winch is strung around the sheave 229*a* and around sheave 228 back to the modular unit. When the winch 210 is operated, the modular unit 202 moves on the track system 222 to the transfer location on the transfer dock 226. The cable 212 is then reconnected from the winch 210 around the sheave 229 and attaches to the point 230 on the modular unit 204. The winch 210 is operated and the modular unit 204 is pulled into the operative position. After the modular unit 204 is in place, the cables 212 are rewound back onto the winch 210 and the truck 206 is driven to the ramp area aligned with the transfer location on the transfer dock 226. The winch cable 212 is then connected to the modular unit 202, and the modular unit 202 loaded onto the truck. The transfer dock 226, as shown in elevation in FIG. 9, has a standard forty-eight inch height which is compatible with most semi-tractor beds and trailers. Eight inch I-beam corner supports 238 of the transfer dock 226 are anchored to thirty-six inch deep by eighteen inch diameter steel reinforced concrete columns 240.

Figure 10A:
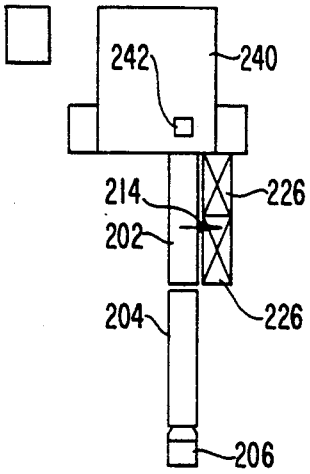
FIGS. 10A through 10E are top schematic views of the rapid transfer system of FIG. 7 illustrating sequentially the replacement movement steps for modules of this invention.
Figure 10B:
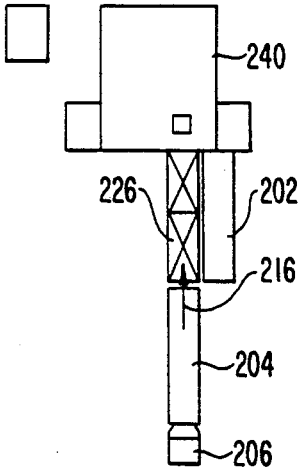
Figure 10C:
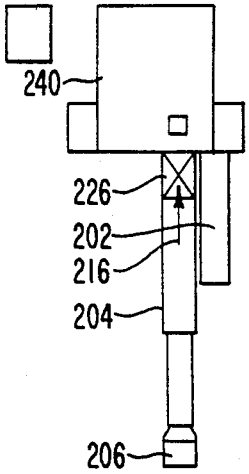
Figure 10D:
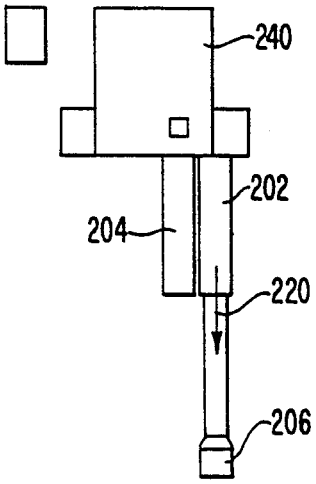
Figure 10E:
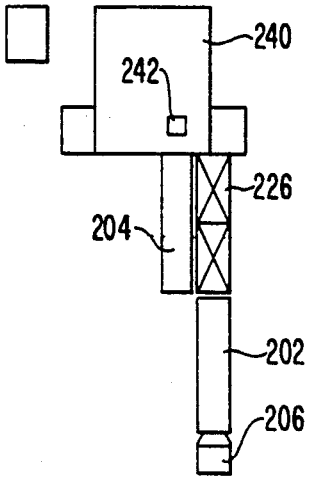

FIGS. 10A–10E schematically show the different steps for replacing one modular unit 202 with the replacement modular unit 204. As shown, the transfer dock 226 having operative and transfer locations thereon is positioned adjacent a building 240. The modular unit 202 at the operative location is then disconnected from equipment shown schematically at 242 within the building 240, the module locking devices removed, the wheels (see wheel assemblies 84 in FIG. 3) rotated ninety degrees (according to a procedure which will be described later) and the rotated wheels locked into place. The flatbed truck 206 with the replacement modular unit 204 thereon then backs up so as to be aligned with the operative location. The winch (210) and cable (212) system is then hooked up around the sheaves, as previously described, and the electric winch operated to move the modular unit 202 sideways to the transfer location; this direction is shown by the arrow 214 in FIG. 10A. Then and referring to FIG. 10B, with the modular unit 202 in the transfer location the winch and cable system is arranged to connect to the replacement modular unit 204 on the flatbed truck 206. The winch and cable system is then operated to move the replacement modular unit 204 rearwardly off of the bed of the truck 206 and onto the transfer dock 226 at the operative location; this movement is shown by the arrow 216 in FIGS. 10B and 10C. The empty truck 206 is then driven to be repositioned to be longitudinally aligned with the transfer location as depicted in FIG. 10D. Then the winching cable system is connected to the modular unit 202 in the transfer location and the winch (210) operated to move the connected unit onto the flatbed truck 206, as shown by the arrow 220 in FIG. 10D. The modular unit 202 is moved until it is completely on the truck bed 208 as shown in FIG. 10E. The truck 206 with the modular unit 202 thereon can then be driven to the repair or storage facility (not shown) or other location. The replacement module 204 at the operative location is operatively connected via standardized plugs with the equipment 242 in the building 240.

The modular unit(s) 202 (or 204) are moved on and between the transfer dock 226 and the flatbed truck 206 on removable wheel assemblies 250 (which can be the same as wheel assemblies 84 in FIG. 3) positionable thereunder. The wheel unit 262 in turn run in longitudinal and lateral tracks 224 of the track system 222 to the desired location(s). The procedures for quickly and easily installing the removable rotating wheel assemblies 250 (in two minutes or less) are illustrated in FIGS. 11–18, and described herebelow.

Figure 11:
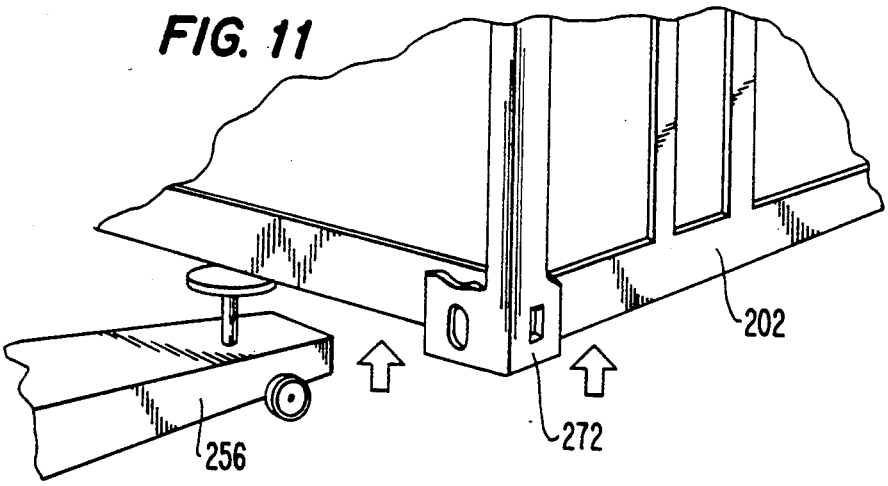
FIG. 11 is a perspective view of a removable rotatable wheel assembly of the present invention illustrating the first installation step.
Figure 12:
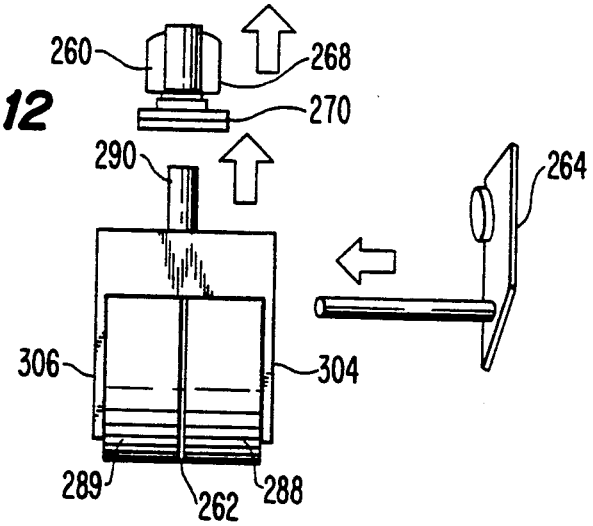
FIG. 12 is a view similar to that of FIG. 11 illustrating the second installation step.
Figure 13:
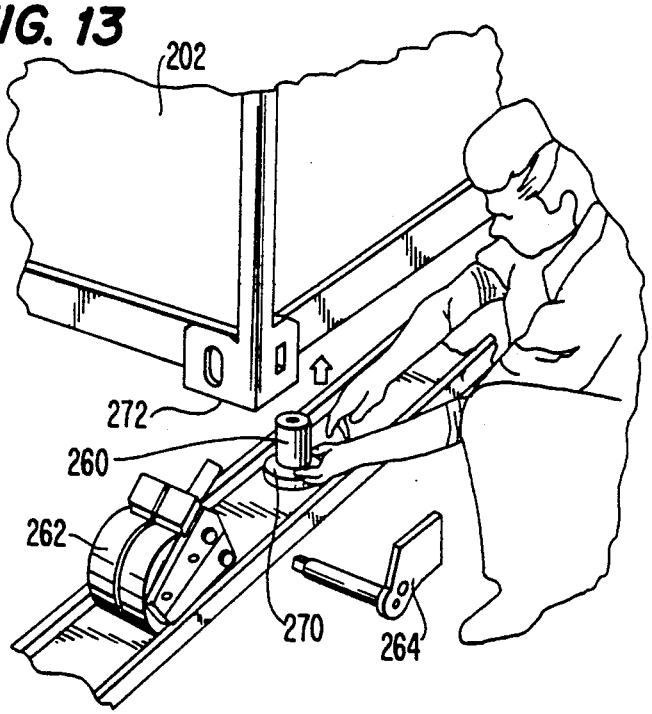
FIG. 13 illustrates the third installation step.
Figure 14:
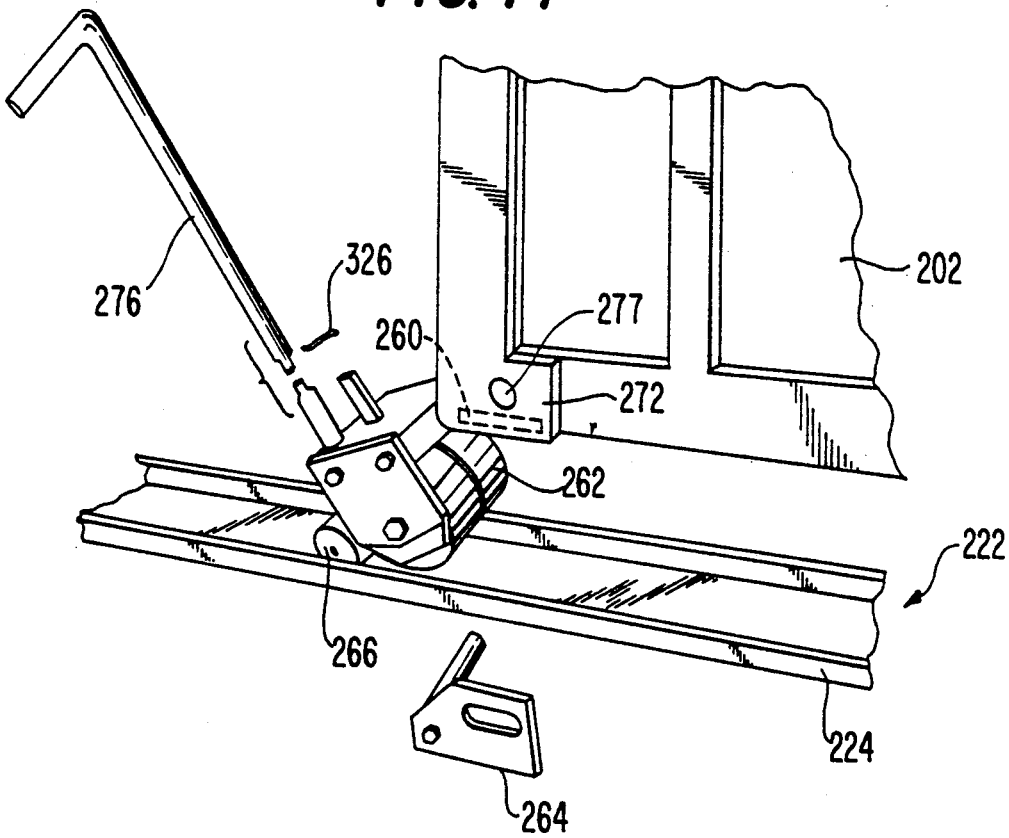
FIG. 14 illustrates the fourth installation step.
Figure 15:
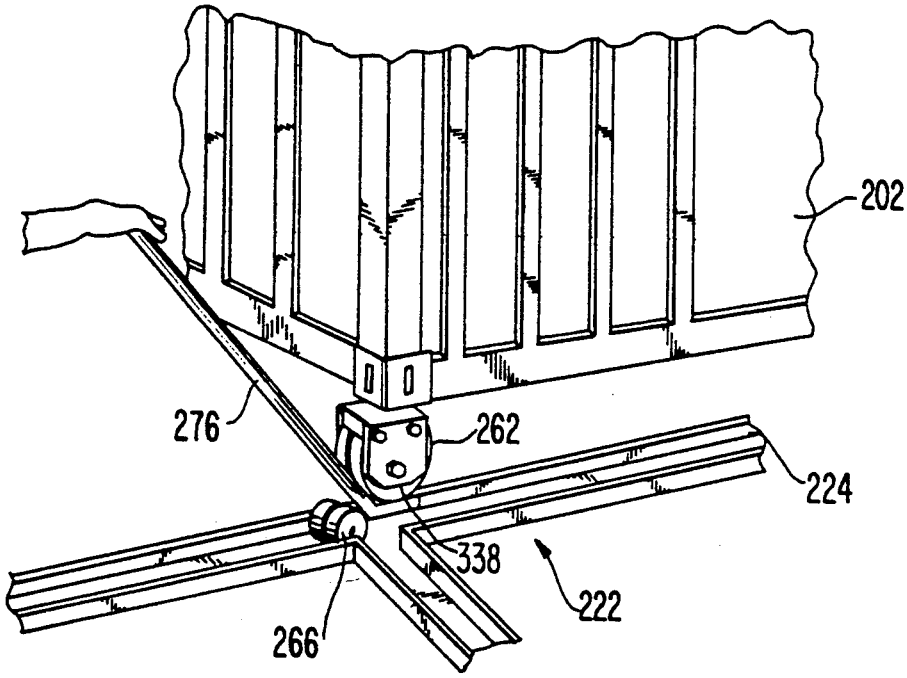
FIG. 15 illustrates the fifth installation step.
Figure 16:
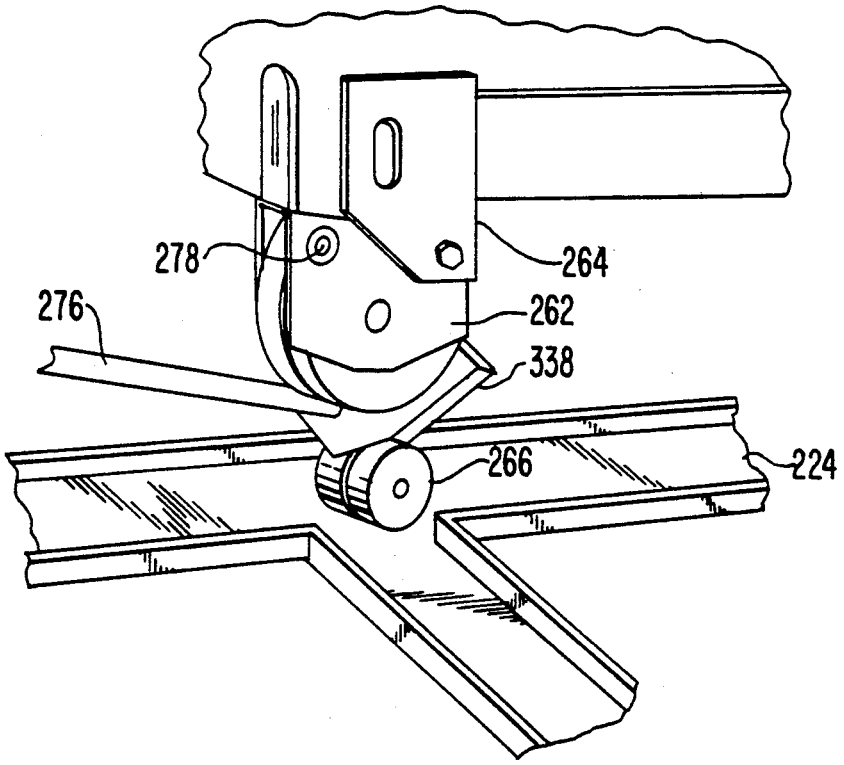
FIG. 16 illustrates the sixth installation step.
Figure 17:
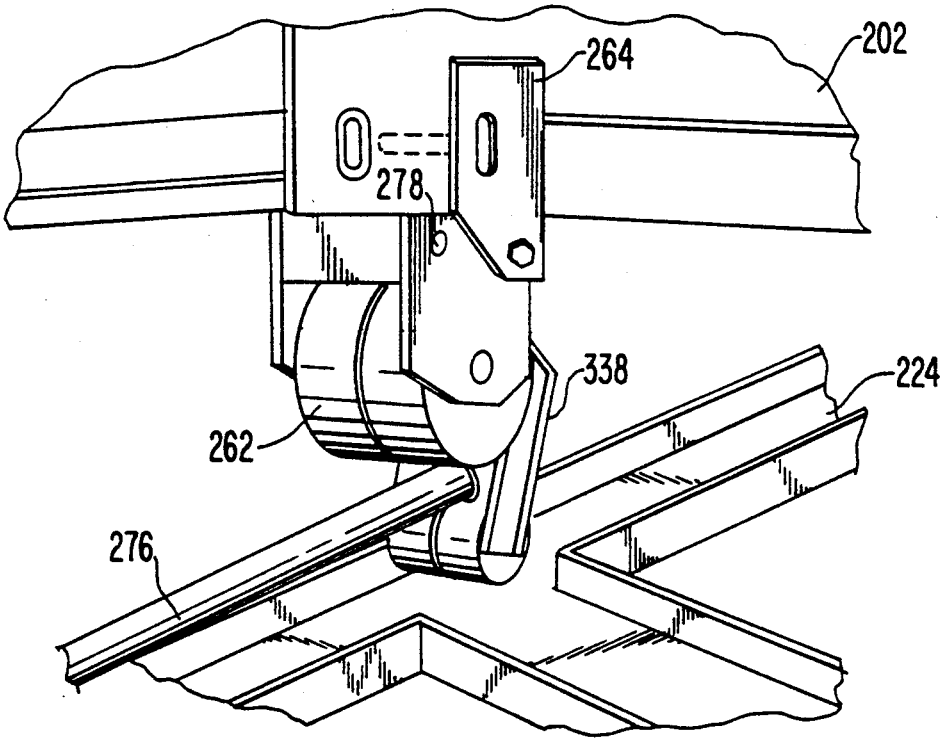
FIG. 17 illustrates the seventh installation step.
Figure 18:
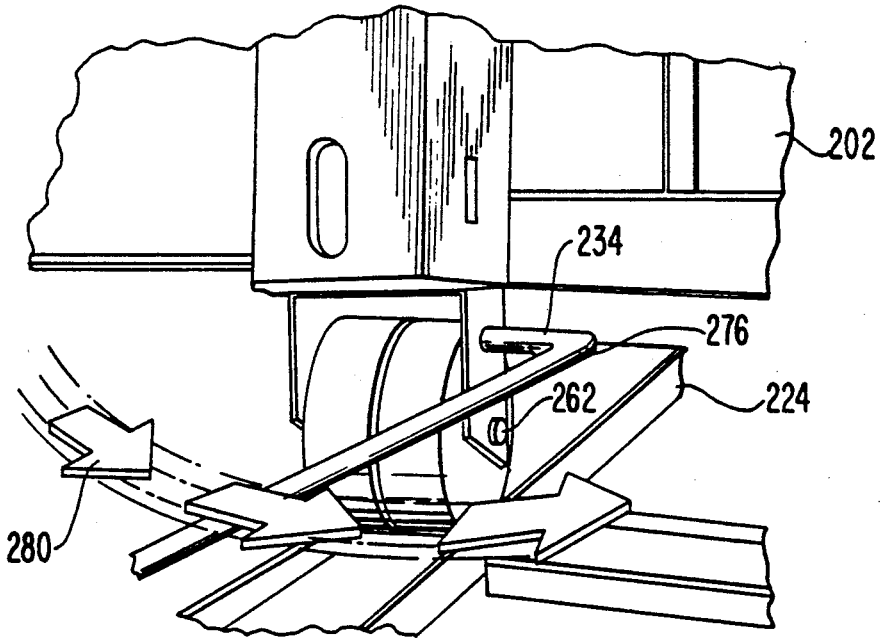
FIG. 18 illustrates the eighth installation step.

The first step, as shown in FIG. 11, is to raise the modular unit 202, using a jack 256, at least twelve inches above the support or track system. The pivot pin holder 260, the removable rotating wheel unit 262 and the wheel support and rotator lock 264 are shown in FIG. 12. The wheel installation and rotation tool 266 is shown in FIG. 14. The second step is to adjust the lock ring tensioner 268 until the lock ring 270 resists movement. The third step, as shown in FIG. 13, is to install the pivot pin holder 260 into the bottom ISO module connector 272 (or 92). With the pivot pin holder 260 fully inserted into the hole of the bottom ISO connector 272, the lock ring 270 of the pivot pin holder 260 is rotated ninety degrees with a hammer and chisel (not shown) to lock the pivot pin therein. The fourth step, as shown in FIG. 14, is to set the wheel unit 262 on the wheel installation and rotation tool 266 and move it thereon along tracks 224 of the rapid transfer track system 222 until it is directly centered under the pivot pin hole. Referring to FIG. 15, the wheel unit 262 is raised by pushing down on the lever 276 of the wheel installation and rotation tool 266 until the wheel unit 262 is completely engaged into the pivot pin hole. Next, the wheel support and rotator lock 264 is simultaneously inserted into the wheel unit 262 and into the side modular hole 277. The keeper pin 278 is installed into the wheel support and rotator lock 264, as shown in FIG. 17. The wheel unit 262 is now locked in a forward position and supported from falling out. The wheel unit 262 can be rotated ninety degrees and locked to enable the modular unit 202 to travel or move sideways; this rotation procedure is shown in FIGS. 17 and 18. The wheel support and rotator lock 264 is removed to enable the wheel unit 262 to swivel, and the lever 276 of the wheel rotation tool 266 is inserted into the wheel rotation hole (as shown by reference numeral 300 in FIGS. 16 and 21). Then by rotating the lever 276, as shown by the arrows 280 in FIG. 18, the wheel unit 262 is rotated to the direction for the desired travel of the modular unit 202.

Figure 19:
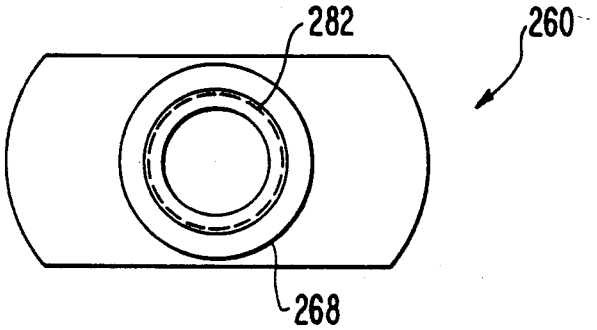
FIG. 19 is a top plan view of the pivot pin holder of the removable rotatable wheel assembly of FIGS. 11–18.
Figure 20:
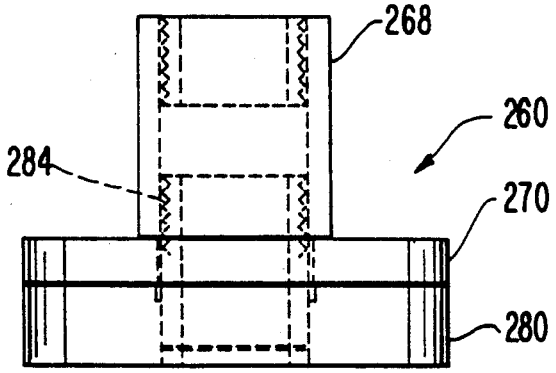
FIG. 20 is an elevational view of the pivot pin holder of FIG. 19.

The pivot pin holder 260, which is shown in isolation and in front and top views in FIGS. 19 and 20, is used to pivot the removable rotator 262 under the hole of each corner ISO connector 272 of the modular unit 202. The pivot pin holder 260 is a unit comprised of a one and one-quarter inch Schedule eighty pipe 282, a one and one-quarter inch Schedule eighty heavy wall coupling lock ring tensioner 268, a one and one-quarter inch Schedule eighty pipe nipple 284, the rotating lock ring 270 and a stationary base holder 286.

Figure 22:
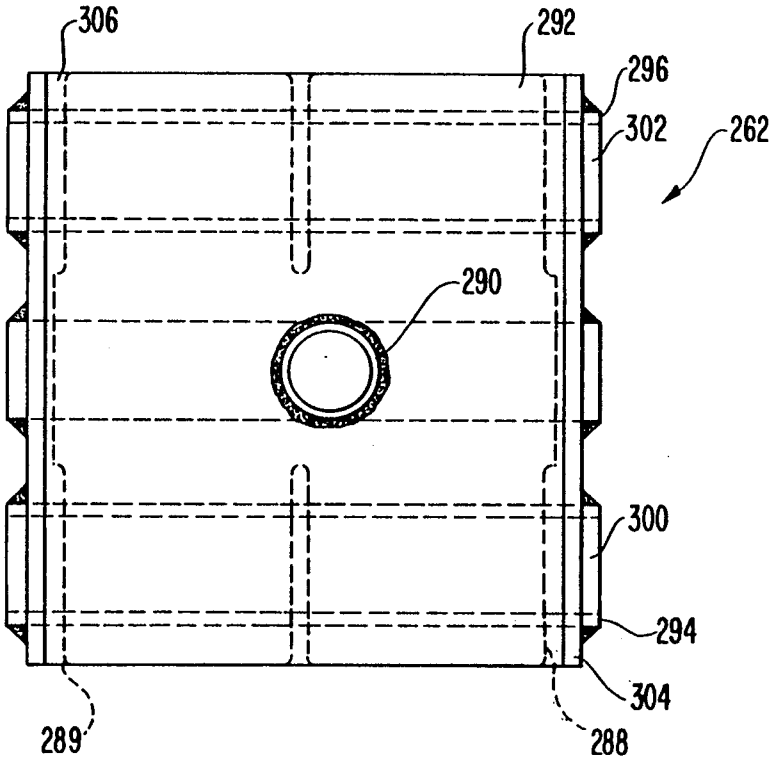
FIG. 22 is a top plan view of the rotating wheel unit of FIG. 21.
Figure 21:
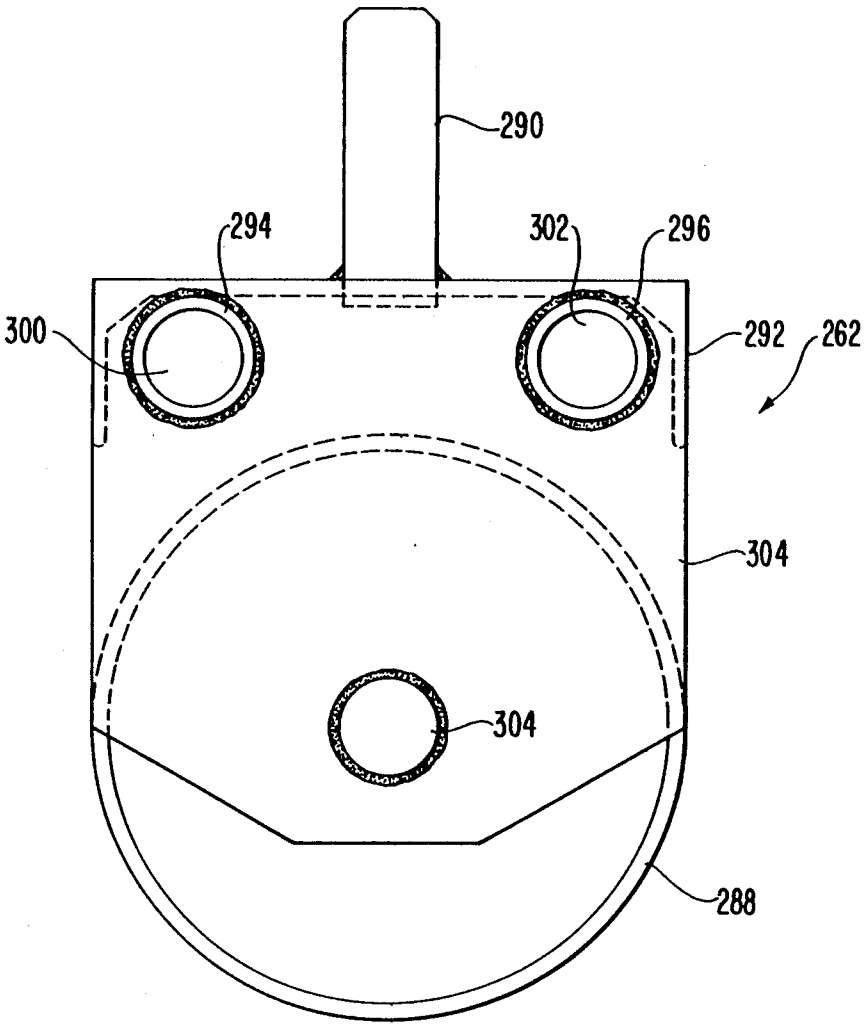
FIG. 21 is an elevational view of the rotating wheel unit of the removable rotatable wheel assembly of FIGS. 11–18.

The rotating wheel unit 262, which is shown in isolation in FIGS. 21 and 22, is designed to support 6,400 pounds of weight at each of the four points of attachment under the corners of the modular unit 202. When installed on the modular unit 202, the wheel unit 262 does not extend outside of the periphery of the modular unit, i.e., beyond the original dimensions of the modular unit. The rotating wheel unit 262 includes a one and one-quarter inch diameter (Schedule eighty) shaft 290 welded to an eight inch channel iron 292 and two one and one-quarter inch Schedule eighty pipes 294, 296. Pipes 294, 296 define holes 300, 302 which are used to tow the modular unit 202 or rotate the wheels 288, 289 to any position about the shaft 290, as shown in FIG. 18. The wheels 288, 289 can thereby be rotated a full three hundred and sixty degrees. A one and one-quarter inch steel shaft 304 extends therethrough and the two eight inch diameter steel wheels 288, 289 rotate thereabout. The modular unit thus does not have rubber tires as do semi-trailers. Since rubber tires can deteriorate or go flat, the removable steel wheels 288, 289 used on the modular units herein are advantageous especially where the system is to be installed for long periods of time. With the wheels removed, the modular units 202 become transportable or stackable, as is shown in FIG. 6. A pair of one-quarter inch parallel flat iron flanges 304, 306 are mounted to the channel iron 292 and the ends of pipes 294, 296 and shaft 304 are welded to them.

Figure 23:
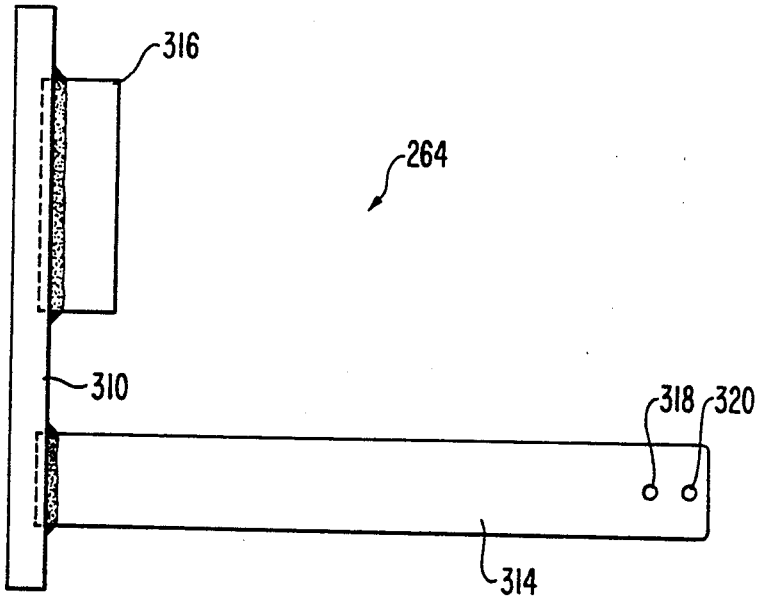
FIG. 23 is a side view of the wheel support and rotor lock of the rotatable wheel assembly of FIGS. 11–18.
Figure 24:
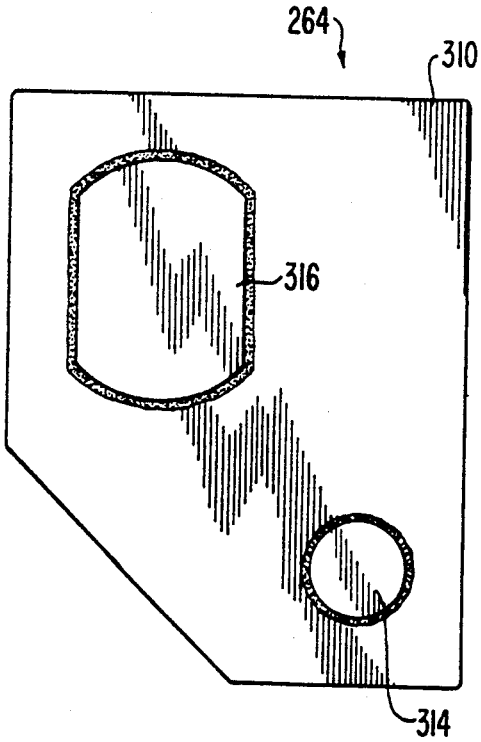
FIG. 24 is a side view of the right front and left rear view wheel support and rotor locks of FIG. 23.
Figure 25:
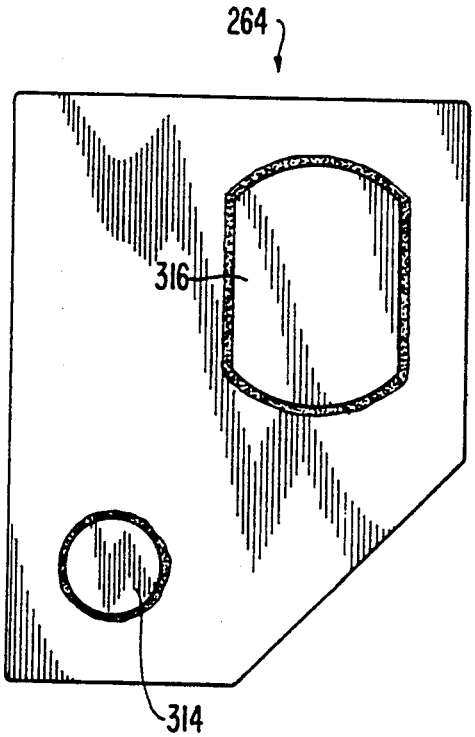
FIG. 25 is a side view of the left front and right rear view wheel support and rotor locks of FIG. 23.

The wheel support and rotator lock 264, which is shown in isolation in FIGS. 23–25, supports the wheel unit 262 from falling out when the modular unit 202 is raised. It also locks the wheel unit 262 in one of its positions, zero degrees for forward and reverse travel or ninety degrees for side travel. Two different designs are used. One is shown in FIG. 24 for the right front and left rear wheel assemblies and the other in FIG. 25 for the left front and right rear wheel assemblies. As seen a plate 310 is provided having a one and one-quarter inch diameter steel shaft 314 welded therein and thereto. A member 316 is welded about its periphery to plate 310. Two one-quarter inch diameter holes 318, 320 for the locking pins pass through the end of the steel shaft as shown in FIG. 23.

Figure 26:
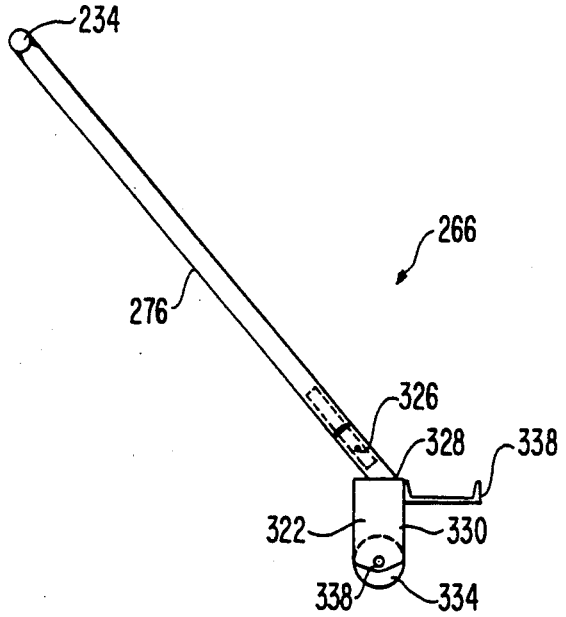
FIG. 26 is a side elevational view of the installation and rotor tool of the rotatable wheel assembly of FIGS. 11–18.
Figure 27:
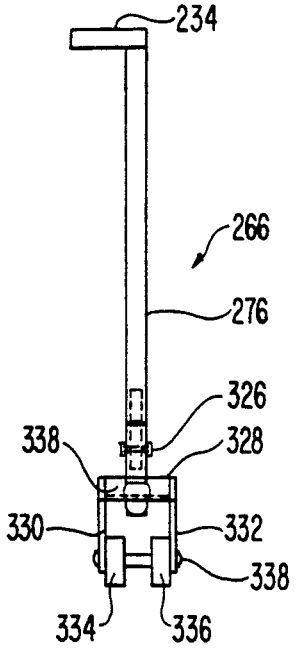
FIG. 27 is a front elevational view of the installation and rotor tool of FIG. 26.

The installation and rotator tool 266, which is shown in isolation in FIGS. 26 and 27, is used to install the wheel unit 262 into the bottom of the ISO connector 272. The elongated lever 276 thereof is used to rotate the wheel unit 262 when separated at the joint of the roller unit 322. As seen the elongated lever 276 has an upper perpendicular handle member 234 which is about six inches long (see also FIG. 18). The lever 276 is secured to the roller unit 322 by a removable locking pin 326 (see also FIG. 14). The roller unit 322 comprises a frame having a base 328 and two parallel depending flanges 330, 332. Two four inch diameter wheels 334, 336 are journaled between the flanges 330, 332, as best seen in FIG. 27, about a one-half inch shaft 338. A six inch channel iron 340 is welded to the front upper part of the base 328, and is used for supporting the wheel unit 262 (see, e.g., FIGS. 15–17).

Figure 28:
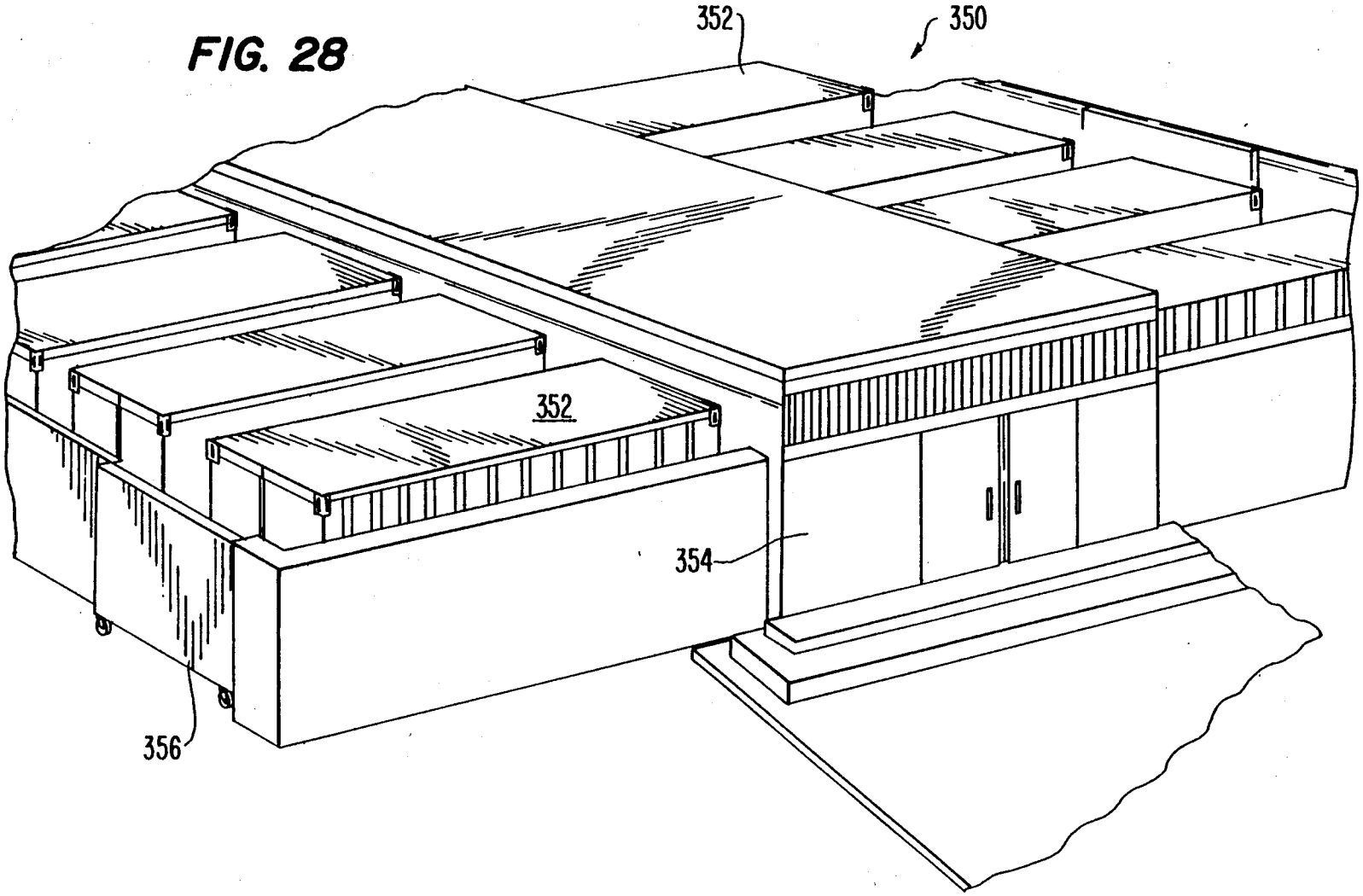
FIG. 28 is a sectional top front perspective view of a critical systems complex of the present invention.
Figure 29:
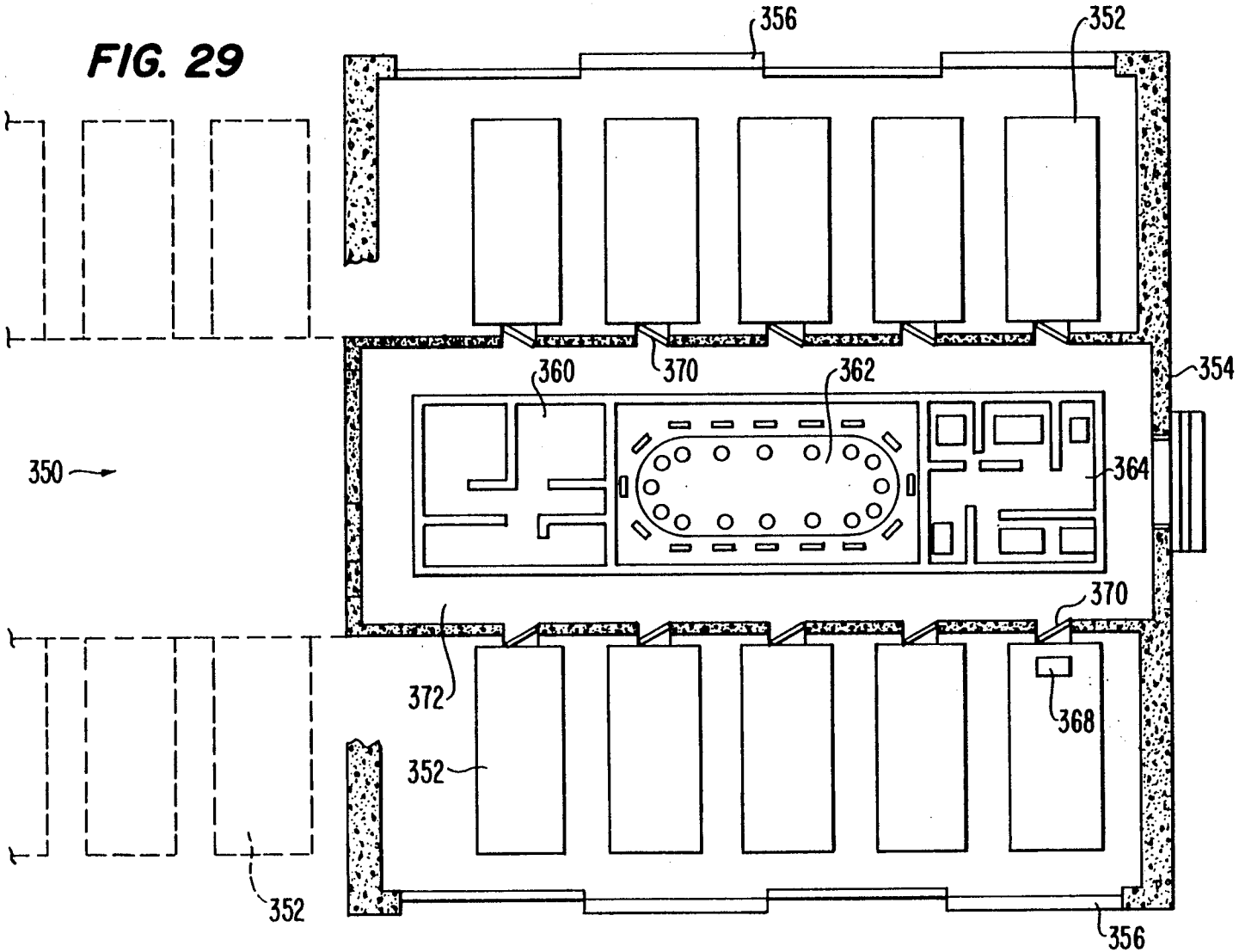
FIG. 29 is a top plan view of the critical systems complex of FIG. 28 with the building roof thereof removed to illustrate the building internal layout.

FIGS. 28 and 29 show a single level critical system complex of the present invention generally at 350 for the protection of personnel and sophisticated equipment, such as computers and communication systems. Power and conditioning equipment modular units or modules 352 are provided for this complex. The complex 350 contains a central core building 354 which is designed for personnel to access each module and control activities in each module such as computer information, phone communications, electrical power, mechanical energy, heating, cooling or any other process that takes place in the modules 352. The center core building 354 can be a main power plant in a large manufacturing facility used to produce electrical power, compressed air, emergency fire pumps, UPS systems, and the like. The modules 352 are located on a rapid transfer system, such as has been previously described, which enables them to be removed by flatbed trucks or trailers, such as 206, through the gates 356. A top internal view of the single level core building 354 is shown in FIG. 29. The executive offices 360, the command center 362, and general offices 364 are all located within the central core building 354. All of the modules 352 can contain computerized detection systems, such as is shown schematically at 368, which will shut down the complete operation of and automatically seal off the modules 352 from the building 354 when an emergency situation is detected, as by closing the fire doors 370 between the office hallways 372 and the modules 352. The detection system 368 can sense fire, smoke, water, hydrogen gas from UPS batteries, unauthorized entry to help protect against sabotage, excessive vibration, and/or earth movement.

The critical systems complex 350 is designed to be disaster resistant and still be portable, above ground and cost effective. The system can, for example, contain computer and communications equipment including modules for power and air conditioning. As shown in FIGS. 28 and 29, the modules 352 that contain the computers and support equipment are located around the perimeter of the central core building 354. This system, thus, is easily expandable as more modules are needed.

Figure 30:
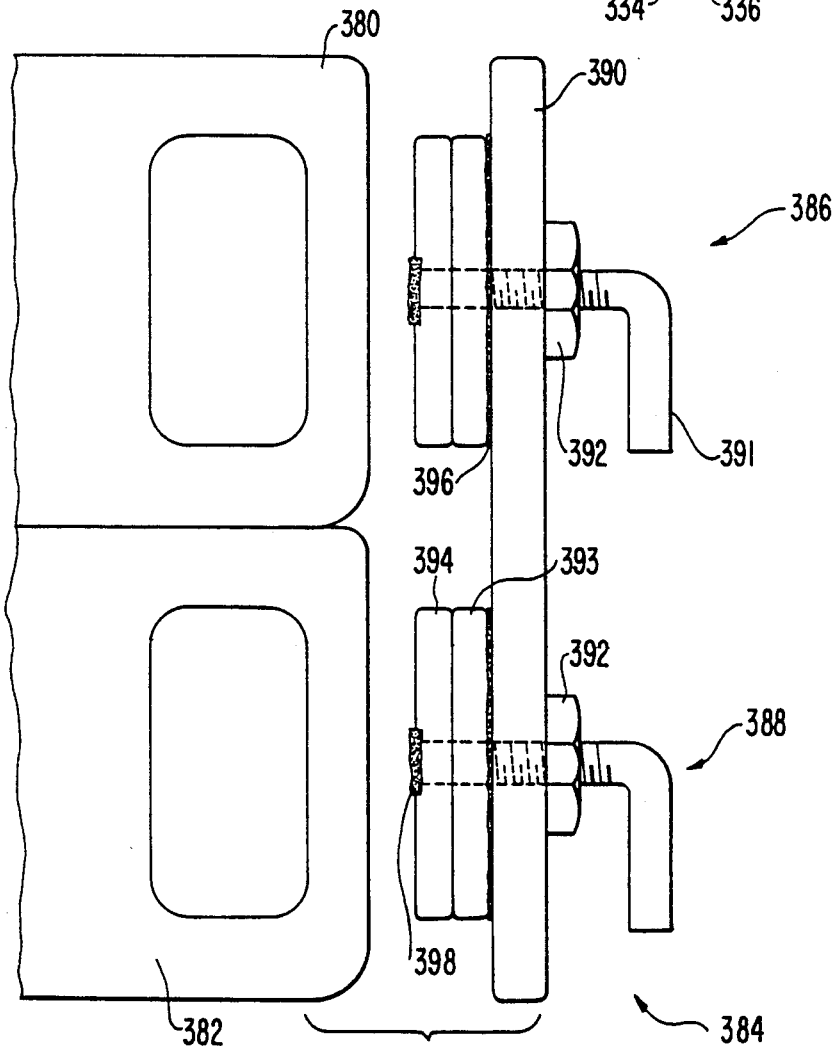
FIG. 30 illustrates a two module locking device of the present invention.

A locking assembly for locking first and second modules 380, 382 of this invention is shown generally at 384 in FIG. 30. It is seen to comprise two similar handle assemblies shown generally at 386 and 388 connected by a one-half inch steel plate lock bar 390. Each handle assembly includes a ninety-degree rotator handle 391, a one inch hex lock nut 392, a three-quarter inch stationary ISO guide 393 and a one-half inch ninety degree rotator lock 394. Weld connections for the handle assemblies are shown at 396 and 398.

Accordingly, the present two-module system enables either module thereof to be quickly replaced without the entire system having to be removed from a building. All of the modules are designed and built to specific dimensions which allow other similar modules of different prime movers and driven equipment to commonly interconnect. This is accomplished by having all of the prime mover output shafts and all of the driven equipment input shafts in the same exact position. Additionally, the flanges on the output and input shafts on both the prime mover and driven equipment are the same type and configuration which allows a universally-adaptable drive shaft to be used to transmit power between generally any two systems. With this two modular system, semi-skilled workers can quickly remove the defective module and install a new module. The defective module is then easily moved to another site and repaired at that site by skilled employees when time permits. Quick disconnect devices are used for the electric, air, water and so forth, and thus highly-skilled workers are not required for the disconnecting steps.

The use of conventional semi-trailers or the single module technology affords flexibility and ease of replacement, but has many disadvantages remedied by the two-module system of the present invention. The present heavy gauge steel walled modules, as compared to the semi-trailers, can withstand the harshest environment, including tornado type winds, with little or no damage. They can also be set directly on the ground for a low profile or transported on the back of flatbed semi-trailers. The removable steel wheels can be installed under the modules to enable them to be off-loaded and rolled on docks, warehouse floors or in the subject specially-designed rapid transfer system for fast and efficient replacement of the modules. The wheels can swivel or lock in a straightforward direction or at a ninety degree angle allowing wheeled travel in any direction.

In conventional systems, days or even weeks can be lost when parts need to be replaced or major components rebuilt. Expensive equipment, such as cranes, and many hours of skilled manpower are often needed. This equipment and manpower, in addition to being expensive, are often not available when needed. With the modular system of this invention the units can be replaced without the use of highly skilled personnel. Using the subject rapid transfer system a semi-skilled worker can usually have the inoperative unit moved out of the way, a new unit installed and the old module loaded on a flatbed trailer ready for transport to a repair facility in a matter of hours.

The size of the system thus can be upgraded, downgraded or removed more quickly and cheaply than can conventional systems. The user thus has the flexibility to make adjustments as his needs change. The modules can be relocated to other areas to perform other tasks on a short notice, which can be beneficial when an emergency situation arises or the use changes.

No special buildings are necessary to house these modular units. The units have their own weatherproof enclosures that will withstand the harshest environments. Decorative enclosure walls with access gates can be used and provided in many materials, styles and colors to blend in with the existing structures or landscapes to thereby be aesthetically pleasing. These modules can be retrofitted in existing buildings or designed into the original architectural plans. Since the units are weatherproof and self-contained, expensive interior space is not required to house them. Parking lots or other accessible areas can be used for installation and provide easy maintenance access.

Thus, the prime mover modules of the present invention are easily transportable, self-contained units. They are pre-wired for lighting and general purpose outlets, and are designed and readily available for chart recorder controllers. They are adaptable to most existing building systems and can control, monitor and provide safety alarms to on-board computers or to distant control centers by way of phone lines or cellular systems. The UPS can protect the recorder control to ensure continued monitoring and control in the event of a power outage.

The present modular system thus can be easily retrofitted to existing facilities and quickly and cheaply expanded, as needed, or removed. The modules protect their critical equipment inside of extra heavy gauge, virtually bullet proof steel insulated with fire resistant materials. The driving unit and driven device can be contained in a single module container. Alternatively, they can be contained in separate unit with a common drive transmitting power between the systems. These modular systems made from heavy duty steel ocean-going cargo containers are virtually disaster proof, easily transported world wide, cost effective and readily adaptable. The modules can be designed and built to contain equipment from diesel generators to the most sophisticated electronic systems, weighing as much as 32,000 pounds. One modular energy system includes three eight foot wide by twenty foot long modular units containing a complete self-contained emergency battery back-up system consisting of a three hundred and thirty-eight KVA UPS and an air conditioning system for a large computer and communications complex.

The present system has universal adaptability among different users of the equipment. Many types of prime movers, from electric motors to engines, can be adapted and used to prime many loads including generators, chillers and mechanical drives.

Figure 31:
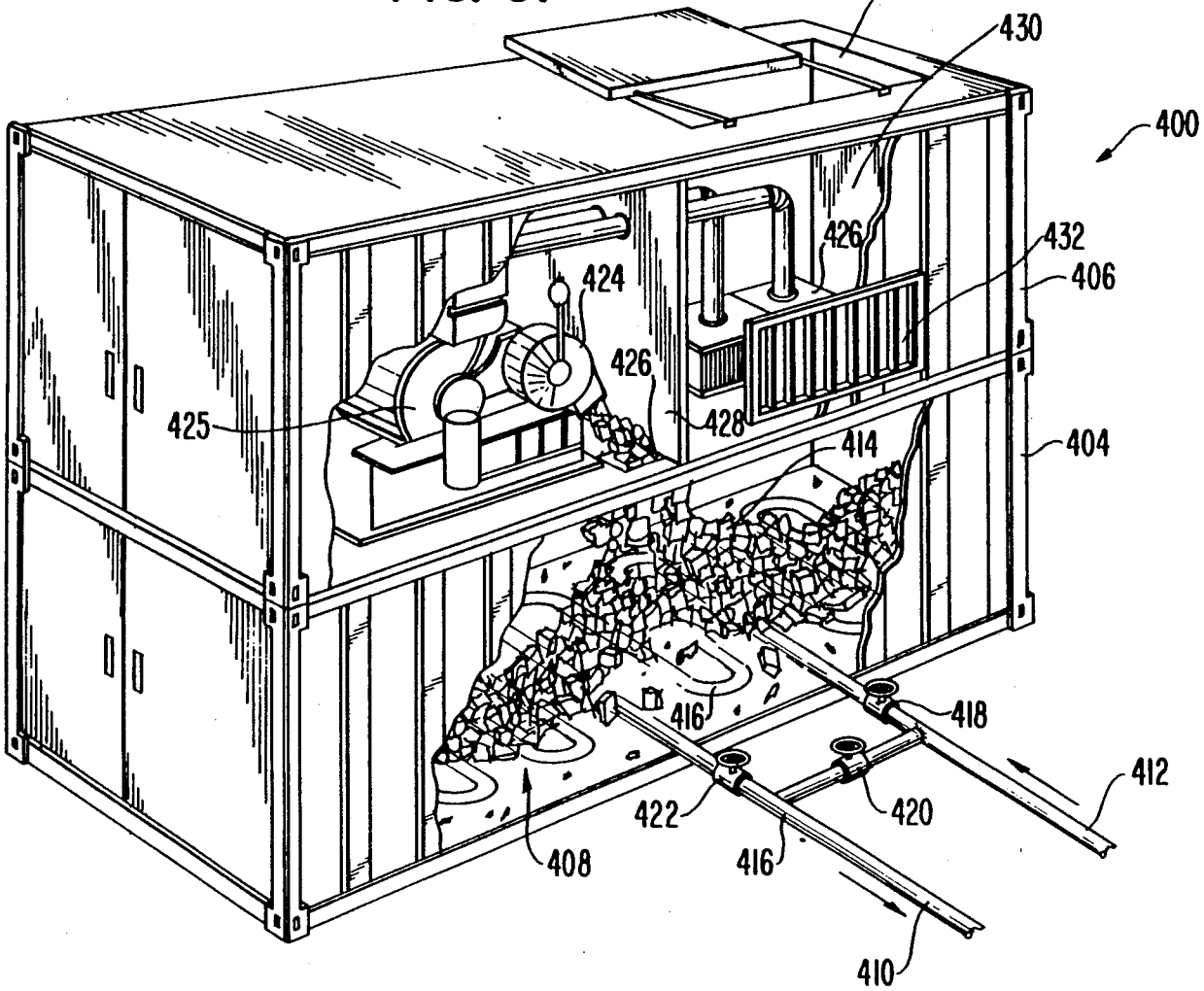
FIG. 31 is a sectional perspective view of an electric modular transportable ice (building) system of the present invention.
Figure 32:
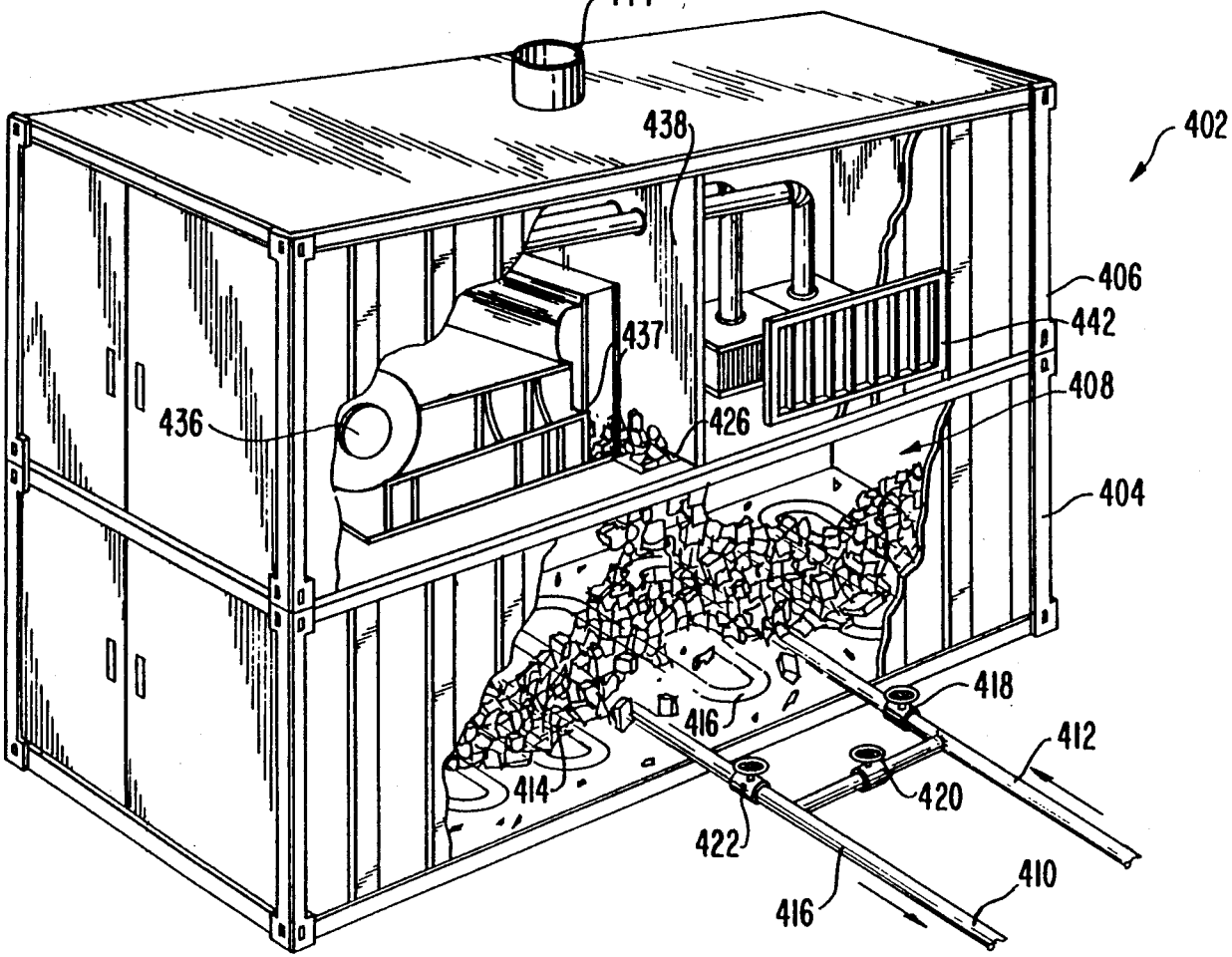
FIG. 32 is a sectional perspective view of an engine driven modular transportable ice building system of the present invention.

Modular transportable ice buildings systems of the present invention are illustrated generally at 400 and 402 in FIGS. 31 and 32. The primary difference between these two systems is that the system 400 of FIG. 31 is an electric driven system 402 and the system of FIG. 32 is an engine driven system. As shown, they are readily constructed and assembled at the site and comprise two preconstructed modular units 404, 406, one on top of the other. A crane would be used to stack them. These modular units can be the previously-described cargo containers. (Alternatively, the units can be mounted in a side-by-side arrangement and an auger (not shown) installed between them to lift the ice up to the top of the storage module.) The bottom unit 404 defines the storage bin shown generally at 408 for the ice produced by the top unit. A typical $8\times8\frac{1}{2}\times20$ foot module which is $\frac{3}{4}$ full of ice represents a seven hundred and fifty cubic feet of ice storage capacity. Passing through the bottom of the bottom storage container is a fluid pipe 410 for connecting with a building chiller system. The water inlet pipe portion 412 is tapped into the return line of the chiller and runs the warm water that has been picked up from the heat of the building during the day through the ice 414 of the ice compartment 408. The warm water which is typically about 65° F. passes through the inlet pipe 412 into the lower module 404 where the pipe section 416 is a curved or coiled to provide a maximum contact with the ice 414 therein. The stored ice 414 cools the water to between 40° and 42° F., and the chilled water then passes out through the outlet pipe portion 416 and into the building chiller system. This piping system also includes an input water valve 418, a bypass valve 420 and a water discharge valve 422. Although the requirements of building chiller systems vary, it is anticipated though that the present piping system would run water therethrough at a rate of fifty to one hundred gallons per minute. The chilled water then returns to the regular chiller system for the building. High rises typically use a chilled water system where the mechanical equipment chills the water instead of removing the heat from the air. The present chiller system can either supplement or replace existing chiller systems.

The ice making machine is positioned in the upper module 406 and is similar to the typical drinking ice machines wherein the water is frozen and when it is ready to be harvested it is defrosted and then dumped into a lower container. The refrigeration system uses freon or ammonia depending upon the size and the customer preference. In the embodiment of FIG. 31 the ice making equipment is an electric motor driven ice builder 424 and ice builder machine 425 whose ice output passes through the ice drop chute 426 through aligned openings in the adjacent containers 404, 406 and then into the bottom container 404. A wall 428 separates the ice building machine 424 from the condenser 426, and keeps the heat from the refrigeration equipment from entering the cavity 430 of the condensing unit. In the condenser cavity 430 of the upper module 406, a lower intake air vent 432 and an upper roof vent 434 for the condenser are provided.

For the engine driven ice builder of FIG. 32, an engine driven ice builder fueled by natural gas is shown at 436, and an ice builder at 437. It similarly has its ice output passing through the ice drop chute 426 into the lower compartment 404. A separator wall 438 separates the ice builder 436 from the air cooled refrigeration condenser 440. Air for the condenser passes through air intake 442 into the upper module 406 and an engine exhaust and condenser vent 444 is provided on the roof.

This modular system fits very well to retrofit applications where large users of power want to reduce their overhead by reducing their electric utility bill. They do this by using more power at night when the rates are typically half that of during the day.

This ice making and storage transportable module system can be adapted for other ice uses. For example, vegetable and fruit growers can use the stored ice for packing their vegetables and fruits, such as lettuce or grapes, in the trucks in the field. The ice can also be used for building roads. In hot climates instead of mixing water in the cement, it is often better to use ice, as the ice allows the concrete to cure at a better rate.

Figure 33:
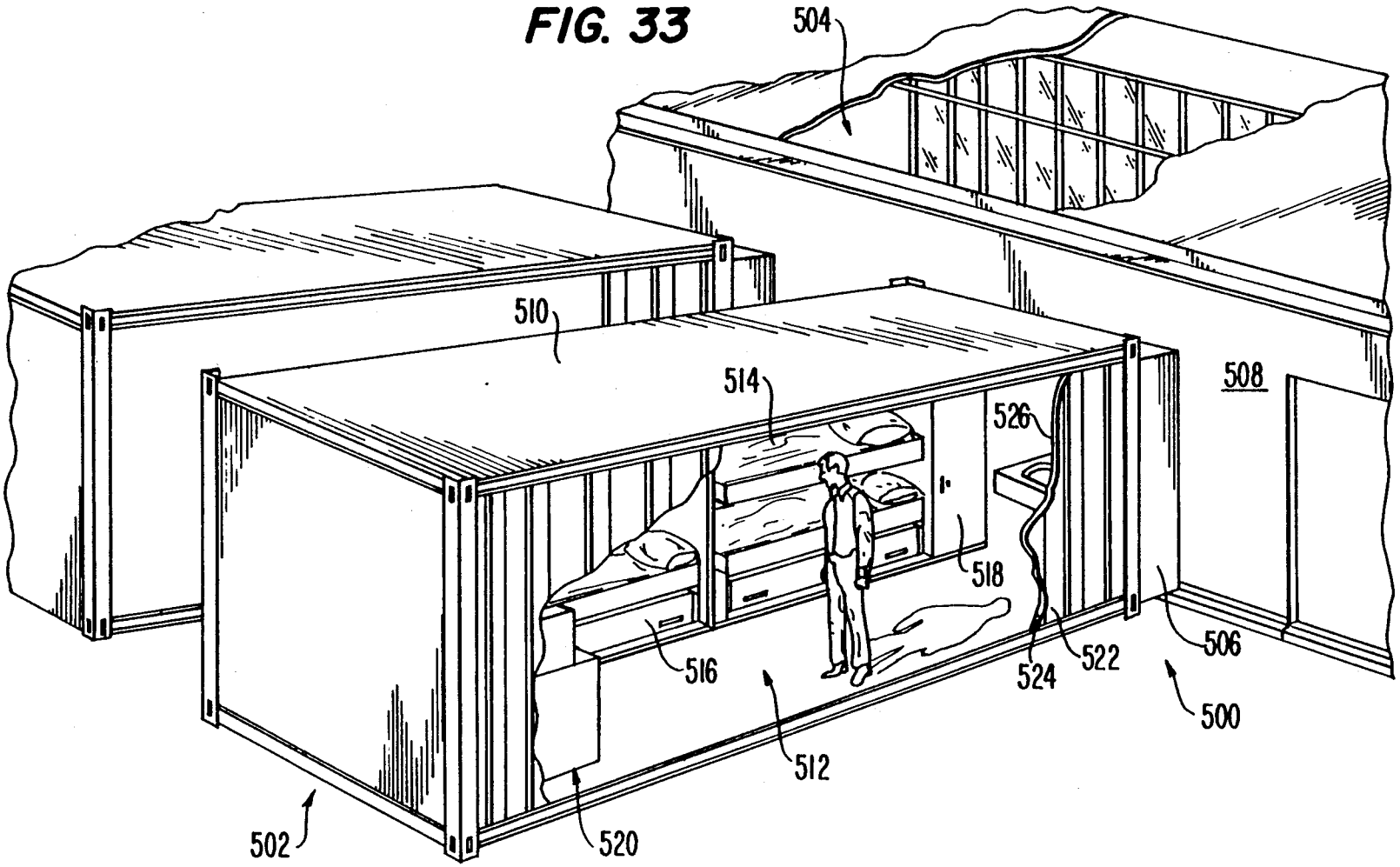
FIG. 33 is a sectional perspective view of a modular living unit system of the present invention.

This economical modular concept of the present invention using retrofitted internationally-standardized ocean cargo (Sea Land) containers can be adapted for other uses. One such use is a destruction resistant modular living unit system for use, for example, by military personnel or by corrections facility inmates. One such system, which is shown generally at 500 in FIG. 33, includes at least one (two are shown) modular living unit 502 positioned adjacent to a main hallway 504 and office facility and communicatively connected thereto by a passageway connector 506. The connector 506 is about one foot wide and bolts up to the ISO connectors of the unit 502. This provides a solid connection so that the unit 502 cannot be moved away from the building 508. A steel channel on the building 508 then mates to the ISO connectors.

Figure 9:
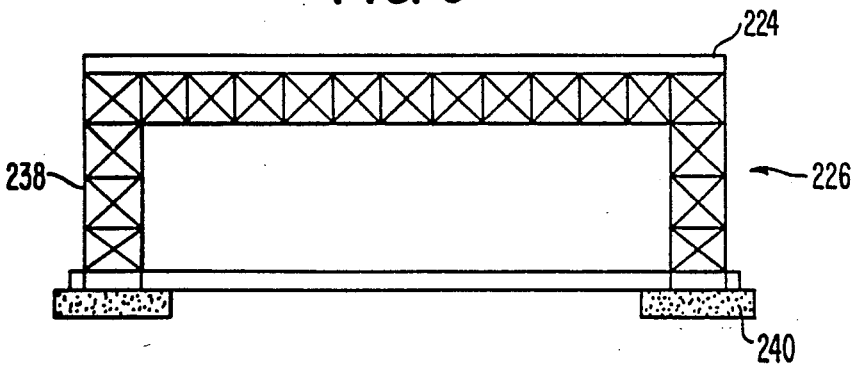
FIG. 9 is an elevational view of the dock arrangement of the system of FIG. 7.

The modular living unit 502 is a heavy duty cargo container 510, such as has been previously described, previously converted at a site away from the building 508, transported thereto when needed and then positioned on steel-concrete corner supports (such as those shown in FIG. 9 at 240). The supports are each eighteen inches in diameter and thirty-six inches deep. The exterior container doors (see the left sides of FIGS. 31 and 32 for example) at the connector end of the unit 502 are closed for transport and opened when the unit is connected to the hallway 504.

The modular living unit 502 provides a complete self-contained living space shown generally at 512. Bunk beds 514, pull-out drawers 516 and lockers 518 are securely mounted in the container 510. The container 510 is pre-wired for lighting and other electrical outlets as needed. The writing utilizes conduits so as to meet all known U.S. building codes. A heating and cooling system for the living space is mounted in the container 510 such as at the corner or end distant from the connector 506. Internal shields can be provided to protect the heating and cooling system from the occupants of the living space so that they cannot tamper with it. The system controls are similarly positioned behind a locked metal door. A security door is installed at the end of the container 510 adjacent to the connector 506. When inmates are to be housed in this modular unit 502, the door can be a security prison bar type door. A restroom facility shown generally 520, including a toilet and wash basin, is also mounted in the living space 512 for the occupants' use.

The container 510 has heavy-duty sixteen to eighteen gauge steel (exterior) walls 522. Fire resistant insulation board 524 is installed on the walls and thick metal interior walls 526 mounted in the container 510. Insulation board 524 is thereby sandwiched between the exterior and interior walls 522, 526. The insulation board 524 can be that one-inch board available from Celtex and having an R value of eleven. It is to thereby meet all state and federal insulation requirements.

Different states have different requirements as to how many square feet must be provided per inmate. It is expected though that the subject eight-by-twenty foot container 510 can accommodate as many as four inmates. The lighting, receptacle(s) and heating and cooling systems are all self-contained and only require water, sewer and electric hookups. The units are adaptable for and easily transportable to any part of the country.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A modular energy system comprising:

a power plant adapted to supply shaft driving power;

power plant controls operatively connected to said power plant;

a power plant module container protectively enclosing said power plant and said power plant controls;

shaft drivable equipment;

equipment controls operatively connected to said shaft drivable equipment;

a driven module container protectively enclosing said shaft drivable equipment and said equipment controls;

a drive shaft operatively connectable to said power plant and to said shaft drivable equipment for transmitting the shaft driving power from said power plant to said shaft drivable equipment; and a transfer means for allowing both said power plant module container and said driven module container together with their enclosed contents to be separately wheeled away and replaced by corresponding replacement module containers enclosing corresponding replacement power plants and controls or corresponding replacement shaft drivable equipment and controls.

2. The modular energy system of claim 1 wherein said transfer means comprises a swivable wheel assembly attachable to and beneath said power plant module container.

3. The modular energy system of claim 2 wherein said transfer means comprises a removable swivable wheel assembly attachable to and beneath said driven module container.

4. The modular energy system of claim 1 wherein said drive shaft is uncouplable from said shaft drivable equipment when at least one of said power plant module container or said driven module container is being replaced by said transfer means.

5. The modular energy system of claim 1 wherein said drive shaft operatively connects said power plant with said shaft drivable equipment, with said power plant module container and said driven module container oriented in an end-to-end position.

6. The modular energy system of claim 1 wherein said drive shaft extends between said power plant module container and said driven module container.

7. The modular energy system of claim 1 wherein said transfer means comprises a removable swivable wheel assembly attachable to and beneath said driven module container.

8. The modular energy system of claim 1 further comprising a structure to which said shaft drivable equipment is operatively connectable when said driven module container is generally adjacent thereto and outside thereof.

9. The modular energy system of claim 8 wherein said structure comprises a building, a movable modular container or a ship.

10. The modular energy system of claim 1 wherein said power plant comprises an engine, a motor or a turbine.

11. The modular energy system of claim 1 wherein said shaft drivable equipment comprises a generator, a compressor, a water pump or a direct drive unit.

12. The modular energy system of claim 1 wherein said power plant includes an output shaft and an output flange on said output shaft, said shaft drivable equipment includes an input shaft and an input flange on said input shaft, and said drive shaft is operatively connectable to and between said input and output flanges.

13. The modular energy system of claim 1 wherein said power plant module container encloses said power plant and said power plant controls in heavy gauge steel walls with fire resistant insulation therein to provide weatherproof (and bullet proof) protection to said power plant and said power plant controls.

14. The modular energy system of claim 1 wherein said driven module container encloses said shaft drivable equipment and said equipment controls in heavy gauge steel walls with fire resistant insulation therein to provide weatherproof and bullet proof protection to said shaft drivable equipment and said equipment controls.

15. The modular energy system of claim 1 wherein said power plant comprises an engine, and further comprising an engine cooling system operatively connected to said engine and protectively enclosed within said power plant module container.

16. The modular energy system of claim 1 wherein said power plant includes a 700 HP piston engine and said shaft drivable equipment includes a 500 KW electric generator.

17. The modular energy system of claim 1 wherein said power plant includes a 700 HP electric motor and said shaft drivable equipment includes a 600 ton refrigeration compressor.

18. The modular energy system of claim 1 wherein said transfer means comprises a transfer dock having an operative location thereon and a transfer location thereon, and a winch and pulley means for moving one said power plant module container or said driven module container from the operative location to the transfer location and then off of said transfer location to an adjacent transport vehicle.

19. The modular energy system of claim 18 wherein said transfer means comprises a wheel assembly attachable to and beneath one said power plant module container or said driven module container, and a track system supported on said transfer dock and in which said wheel assembly rotatably travels.

20. The modular energy system of claim 19 wherein said track system includes a lateral track extending between the operative and transfer locations and a longitudinal track perpendicular to and interconnecting with said lateral track, and said wheel assembly is swivable ninety degrees so that said module container attached thereto can be made to travel by said winch and pulley means along alternatively both said lateral and longitudinal tracks.

* * * * *